US010794636B2

(12) United States Patent
Inoue et al.

(10) Patent No.: US 10,794,636 B2
(45) Date of Patent: Oct. 6, 2020

(54) HEAT EXCHANGER AND AIR CONDITIONER

(71) Applicant: DAIKIN INDUSTRIES, LTD., Osaka (JP)

(72) Inventors: Satoshi Inoue, Osaka (JP); Tomohiko Sakamaki, Osaka (JP); Tomoya Yamaguchi, Osaka (JP); Ken Satou, Osaka (JP); Kouju Yamada, Osaka (JP); Masanori Jindou, Osaka (JP); Yoshio Oritani, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/337,912

(22) PCT Filed: Sep. 29, 2017

(86) PCT No.: PCT/JP2017/035583
§ 371 (c)(1),
(2) Date: Mar. 28, 2019

(87) PCT Pub. No.: WO2018/062519
PCT Pub. Date: Apr. 5, 2018

(65) Prior Publication Data

US 2019/0257594 A1 Aug. 22, 2019

(30) Foreign Application Priority Data

Sep. 29, 2016 (JP) ..... 2016-191264

(51) Int. Cl.
*F28F 1/32* (2006.01)
*F28D 1/053* (2006.01)
(Continued)

(52) U.S. Cl.
CPC ..... *F28F 1/32* (2013.01); *F24F 1/18* (2013.01); *F25B 39/00* (2013.01);
(Continued)

(58) Field of Classification Search
CPC .... F28D 1/05325; F28D 1/05391; F28F 1/18; F28F 1/32; F28F 9/0204; F28F 9/0224;
(Continued)

(56) References Cited

U.S. PATENT DOCUMENTS 6,688,137 B1 * 2/2004 Gupte ..... F28F 9/0265 62/515
9,459,057 B2 * 10/2016 Wand ..... F28F 9/0273
(Continued)

FOREIGN PATENT DOCUMENTS

DE 202008011555 U1 1/2010
DE 102011007749 A1 10/2011
(Continued)

OTHER PUBLICATIONS

English translation of International Preliminary Report on Patentability (PCT/IB/338 and PCT/IB/373) issued in counterpart international Application No. PCT/JP2017/035583, dated Apr. 2, 2019 (18 pages).
(Continued)

*Primary Examiner* — Eric S Ruppert
*Assistant Examiner* — Hans R Weiland
(74) *Attorney, Agent, or Firm* — Osha Liang LLP

(57) ABSTRACT

An outdoor heat exchanger includes a plurality of flat multi-hole tubes, a return header, a plurality of heat transfer fins, and a partition including a concave-convex portion on the leeward side. A space inside the return header to which the flat multi-hole tubes are connected is formed so as to
(Continued)

cause a larger amount of refrigerant to flow on the upstream side than on the downstream side in an airflow direction.

9 Claims, 13 Drawing Sheets

(51) Int. Cl.

| | |
|---|---|
| ***F28F 9/02*** | (2006.01) |
| ***F24F 1/18*** | (2011.01) |
| ***F25B 39/00*** | (2006.01) |
| *F28D 21/00* | (2006.01) |

(52) U.S. Cl.
CPC ..... *F28D 1/05325* (2013.01); *F28D 1/05391* (2013.01); *F28F 9/0204* (2013.01); *F28F 9/0224* (2013.01); *F28F 9/0263* (2013.01); *F28F 9/0268* (2013.01); *F28F 9/0282* (2013.01); *F28D 2021/0068* (2013.01)

(58) Field of Classification Search
CPC ..... F28F 9/0263; F28F 9/0265; F28F 9/0268; F28F 9/0278; F28F 9/028; F28F 2009/029; F28F 2009/0292
See application file for complete search history.

(56) References Cited

U.S. PATENT DOCUMENTS

| | | | | |
|---|---|---|---|---|
| 2004/0031598 | A1* | 2/2004 | Shimanuki | F28F 1/022 165/164 |
| 2007/0062679 | A1* | 3/2007 | Agee | F28F 9/02 165/158 |
| 2013/0199288 | A1 | 8/2013 | Goenka | |
| 2014/0202673 | A1* | 7/2014 | Wand | F28F 9/0273 165/175 |
| 2015/0053384 | A1* | 2/2015 | Ishibashi | F28F 9/0265 165/173 |
| 2016/0327317 | A1* | 11/2016 | Inoue | F28F 9/028 |
| 2017/0122666 | A1 | 5/2017 | Jo et al. | |

FOREIGN PATENT DOCUMENTS

| | | | | |
|---|---|---|---|---|
| DE | 112015000097 | T5 | 3/2016 | |
| EP | 3064880 | A1 | 9/2016 | |
| EP | 3088831 | A1 | 11/2016 | |
| JP | H06-123587 | A | 5/1994 | |
| JP | 2004-293874 | A | 10/2004 | |
| JP | 2005-127597 | A | 5/2005 | |
| JP | 2005-201491 | A | 7/2005 | |
| JP | 2011-075165 | A | 4/2011 | |
| JP | 2014-037899 | A | 2/2014 | |
| JP | 2014-156990 | A | 8/2014 | |
| JP | 2016-023815 | A | 2/2016 | |
| JP | 2016-125748 | A | 7/2016 | |
| WO | 2014079357 | A1 | 5/2014 | |
| WO | 2015/063875 | A1 | 5/2015 | |
| WO | 2015/097876 | A1 | 7/2015 | |
| WO | WO-2015098859 | A1 * | 7/2015 | F28F 9/028 |

OTHER PUBLICATIONS

Office Action issued in corresponding Japanese Patent Application No. 2017-189788 dated Dec. 19, 2017, with translation (18 pages).
International Search Report issued in corresponding International Application No. PCT/JP2017/035583 dated Dec. 26, 2017, with translation (7 pages).
Written Opinion of the International Searching Authority issued in corresponding International Application No. PCT/JP2017/035583 dated Dec. 26, 2017 (9 pages).
Extended European Search Report issued in corresponding European Patent Application No. 17856466.2, dated Aug. 8, 2019 (7 pages).

* cited by examiner

HEAT EXCHANGER AND AIR CONDITIONER

TECHNICAL FIELD

The present invention relates to a heat exchanger and an air conditioner.

BACKGROUND

A heat exchanger that includes a plurality of flat multi-hole tubes, fins joined to the plurality of flat multi-hole tubes, and a header coupled to end portions of the plurality of flat multi-hole tubes and that causes a refrigerant that flows inside the flat multi-hole tubes to exchange heat with air that flows outside the flat multi-hole tubes has been known.

For example, Patent Literature 1 (Japanese Unexamined Patent Application Publication No. 2005-201491) and Patent Literature 2 (Japanese Unexamined Patent Application Publication No. 2005-127597) each disclose a heat exchanger that addresses a problem of an imbalance in the degree of superheating that is large on the upstream side and small on the downstream side as a result of a heat exchange being performed preferentially on the upstream side in an airflow direction. Specifically, to solve the problem in these heat exchangers, it is suggested to form each of the plurality of flow paths included in the flat multi-hole tubes so as to have a shape that differs between the windward side and the leeward side to cause a heat exchange amount on the windward side to be larger than a heat exchange amount on the leeward side.

In the above-described heat exchangers presented in Patent Literature 1 and Patent Literature 2, however, the pressure-resistance strength of the flow paths of the flat multi-hole tubes differs between the windward side and the leeward side because each of the plurality of flow paths included in the flat multi-hole tubes is formed so as to have a shape that differs between the windward side and the leeward side to improve a balance between the heat exchange amount on the windward side and that on the leeward side. Specifically, the pressure-resistance strength is inferior on the windward side of the flat multi-hole tubes compared with that on the leeward side because the sectional area of the flow paths is large on the windward side compared with that on the leeward side.

SUMMARY

A heat exchanger and an air conditioner according to one or more embodiments are capable of minimizing a difference in state between a refrigerant that flows on the windward side and a refrigerant that flows on the leeward side in flat multi-hole tubes even when a difference in pressure-resistance strength between the windward side and the leeward side of the flat multi-hole tubes is minimized.

A heat exchanger according to a first example of one or more embodiments includes a plurality of flat multi-hole tubes, a header, and a plurality of fins. The flat multi-hole tubes are disposed such that a direction intersecting a direction of an airflow is a longitudinal direction of each flat multi-hole tube. The plurality of multi-hole tubes are disposed in line. An end portion of each of the plurality of flat multi-hole tubes is connected to the header. The plurality of fins are joined to the flat multi-hole tubes. A space inside the header to which the flat multi-hole tubes are connected is formed so as to cause a larger amount of a refrigerant to flow on a upstream side than on a downstream side in the direction of the airflow.

In existing heat exchangers, a temperature difference between air and a refrigerant is larger on the windward side than on the leeward side, and a heat exchange amount thus tends to be large on the windward side. Therefore, the state of the refrigerant is sometimes different such that, for example, the degree of superheating of a refrigerant that has flowed on the windward side of the flat multi-hole tubes tends to be large compared with that of a refrigerant that has flowed on the leeward side. To solve this issue, the flat multi-hole tubes may be formed so as to have heat exchange characteristics that differ between the windward side and the leeward side. In this case, however, the flat multi-hole tubes are manufactured such that the shape of each of the flow paths of the flat multi-hole tubes differs between the windward side and the leeward side, which may decrease the pressure-resistance strength of the flat multi-hole tubes.

Meanwhile, in the heat exchanger according to the first example of one or more embodiments discussed above, the space inside the header to which the flat multi-hole tubes are connected is formed so as to cause a larger amount of a refrigerant to flow on the upstream side than on the downstream side in the direction of the airflow. Therefore, it is possible to supply a larger amount of the refrigerant on the windward side than on the leeward side to the flat multi-hole tubes. Accordingly, it is possible to minimize a difference in state between the refrigerant that flows on the windward side and the refrigerant that flows on the leeward side in the flat multi-hole tubes without forming each of the flow paths of the flat multi-hole tubes so as to have a shape that greatly differs between the windward side and the leeward side.

A heat exchanger according to a second example of one or more embodiments is similar to the heat exchanger according to the first aspect; in addition, the space inside the header to which the flat multi-hole tubes are connected is formed such that a space that allows the refrigerant to pass therethrough is wider on the upstream side than on the downstream side in the direction of the airflow.

Here, for example, in the space inside the header to which the flat multi-hole tubes are connected, an average of a refrigerant-passage sectional area (passage sectional area when the refrigerant passes in the longitudinal direction of the header) of the space that allows the refrigerant to pass therethrough on the upstream side in the direction of the airflow may be larger than an average of a refrigerant-passage sectional area of a space that allows the refrigerant to pass therethrough on the downstream side. The average of the refrigerant-passage sectional area on the windward side may be a value that is obtained by dividing the volume of the space that allows the refrigerant to pass therethrough on the windward side by the length of the space that allows the refrigerant to pass therethrough on the windward side in a direction along the longitudinal direction of the header, and the average of the refrigerant-passage sectional area on the leeward side may be a value that is obtained by dividing the volume of the space that allows the refrigerant to pass therethrough on the leeward side by the length of the space that allows the refrigerant to pass therethrough on the leeward side in the direction along the longitudinal direction of the header.

In addition, the upstream side and the downstream side may be distinguished from each other on the basis of a reference set at an intermediate position in the direction of the airflow in the space inside the header to which the flat multi-hole tubes are connected.

In this heat exchanger, the space inside the header to which the flat multi-hole tubes are connected is formed so as to have the wider space that allows the refrigerant to pass therethrough on the upstream side than on the downstream side in the direction of the airflow. Therefore, the refrigerant that flows through the space inside the header to which the flat multi-hole tubes are connected flows more easily on the windward side, where a pressure loss due to passage is relatively small, than on the leeward side, where the pressure loss due to passage is relatively large.

A heat exchanger according to a third example of ore or more embodiments is similar to the heat exchanger according to the second example; in addition, a portion that faces the end portion of each of the flat multi-hole tubes on the leeward side is provided with a concave-convex portion including a convex portion that projects toward a side of the flat multi-hole tubes and an oppositely-recessed concave portion. The portion is a part of a contour of the space inside the header to which the flat multi-hole tubes are connected.

Here, a portion, which is the part of the contour of the space inside the header to which the flat multi-hole tubes are connected, facing the end portion of each of the flat multi-hole tubes on the windward side may not be provided with the aforementioned concave-convex portion or may be provided with a concave-convex portion that has a concave-convex height lower than that of the concave-convex portion on the leeward side.

The convex portion and the concave portion constituting the concave-convex portion each may extend in the longitudinal direction of the header. Here, when an inflow port through which the refrigerant flows into the space inside the header to which the flat multi-hole tubes are connected is provided, the concave-convex portion and the inflow port may be arranged so as not to overlap each other or such that half or more of the inflow port is not covered when viewed in the longitudinal direction of the concave-convex portion.

In this heat exchanger, the concave-convex portion is provided at the portion that faces the end portion of each of the flat multi-hole tubes on the leeward side, the portion being the part of the contour of the space inside the header to which the flat multi-hole tubes are connected. Therefore, the refrigerant that passes on the leeward side of the space inside the header to which the flat multi-hole tubes are connected is easily subjected to a pressure loss caused by the surface of the concave-convex portion. Consequently, it is possible to cause the refrigerant to flow on, in particular, the windward side in the space inside the header to which the flat multi-hole tubes are connected.

A heat exchanger according to a fourth example of one or more embodiments is similar to the heat exchanger according to the first example, and additionally the heat exchanger may have a specific-surface-area difference structure. The specific-surface-area difference structure is a structure in which the portion that faces the end portion of each of the flat multi-hole tubes has a specific surface area larger on the upstream side than on the downstream side in the direction of the airflow, the portion being a part of the contour of the space inside the header to which the flat multi-hole tubes are connected.

Here, the specific-surface-area difference structure is a structure in which the specific surface area, which is a surface area per unit area of a projection portion of the portion that faces the end portion of each of the flat multi-hole tubes inserted into the header as viewed in an insertion-advancing direction of the flat multi-hole tubes with respect to the header, is larger on the upstream side than on the downstream side in the direction of the airflow. The specific-surface-area difference structure only needs to be provided at a portion that faces the end portion of each of the flat multi-hole tubes and may be provided at a member, such as a partitioning member, disposed inside the header or may be provided at an inner circumferential surface of the header. The specific-surface-area difference structure may be constituted by a concave-convex shape that is provided at an upstream-side portion so as to extend in an up-down direction, the upstream-side portion being an upstream side part, in the direction of the airflow, of the partitioning member facing the end portion of each of the flat multi-hole tubes. In this case, it is possible to guide a liquid refrigerant in the up-down direction by causing the liquid refrigerant to flow along a portion that has a large specific surface area, and it is thus possible to guide a large amount of the liquid refrigerant more reliably to the windward side of the flat multi-hole tubes.

In this heat exchanger, a portion on the windward side having a relatively large specific surface area has a large surface area due to the provision of the specific-surface-area difference structure and thus is capable of holding a larger amount of the liquid refrigerant on a surface than a portion on the leeward side having a relatively small specific surface area. Therefore, it is possible to supply a larger amount of the liquid refrigerant on the windward side to the flat multi-hole tubes than on the leeward side. Accordingly, it is possible to minimize a difference in state between the refrigerant that flows on the windward side and the refrigerant that flows on the leeward side in the flat multi-hole tubes without forming each of the flow paths of the flat multi-hole tubes so as to have a shape that greatly differs between the windward side and the leeward side.

A heat exchanger according to a fifth example of one or more embodiments is similar to the heat exchanger according to the first example; in addition, the flat multi-hole tubes each have a shape that is symmetrical between the upstream side and the downstream side with a border at an intermediate position in the direction of the airflow. The flat multi-hole tubes each include a plurality of flow paths that have a common flow-path sectional area.

In this heat exchanger, the flat multi-hole tubes each have the shape that is symmetrical between the windward side and the leeward side. Therefore, it is possible to obtain the same shape during the manufacture of the heat exchanger regardless of whether construction is performed with the flat multi-hole tubes directed toward the upstream side or toward the downstream side for assembling the flat multi-hole tubes. Accordingly, it is possible to suppress the flat multi-hole tubes from being incorrectly assembled during the manufacture of the heat exchanger. In addition, it is possible to improve the pressure-resistance strength of the flat multi-hole tubes because a plurality of the flow paths of the flat multi-hole tubes have the common flow-path sectional area. Consequently, it is possible to improve the pressure-resistance strength while suppressing the flat multi-hole tubes from being incorrectly assembled during manufacture.

A heat exchanger according to a sixth example of one or more embodiments is similar to the heat exchanger according to any of the first example to the fifth example; in addition, the plurality of fins are connected to each other on the upstream side of the plurality of flat multi-hole tubes in the direction of the airflow.

In this heat exchanger, the plurality of fins are connected to each other on the upstream side of the plurality of flat multi-hole tubes in the direction of the airflow, and thus, a heat transfer area is increased by a degree corresponding to mutually connected portions of the fins. Therefore, the heat exchange amount of the refrigerant that flows through each of the flow paths of the flat multi-hole tubes tends to be increased more on the windward side than on the leeward side. Meanwhile, this heat exchanger is capable of guiding a larger amount of the refrigerant to the windward side of the flat multi-hole tubes even in the structure in which the heat exchange amount of the refrigerant that flows through each of the flow paths of the flat multi-hole tube is thus increased more on the windward side than on the leeward side due to the arrangement of the fins. It is thus possible to minimize a difference in state between the refrigerant that flows on the windward side and the refrigerant that flows on the leeward side in the flat multi-hole tubes.

Even when the aforementioned heat exchanger is used as a refrigerant evaporator in a refrigeration apparatus in which the aforementioned heat exchanger is employed, it is possible to suppress frost from adhering concentratively to the upstream side end portions of the flat multi-hole tubes in the direction of the airflow because the heat transfer area is increased due to the provision of the mutually connected portions of the fins on the windward side of the flat multi-hole tubes.

A heat exchanger according to a seventh example of one or more embodiments is similar to the heat exchanger according to any of the first example to the sixth example; in addition, the header includes a partitioning member. The partitioning member partitions a side where the flat multi-hole tubes are connected and a side opposite to the side where the flat multi-hole tubes are connected from each other. A part of the contour of the space inside the header to which the flat multi-hole tubes are connected is constituted by the partitioning member.

In this heat exchanger, it is possible to reduce a distance between the end portion of each of the flat multi-hole tubes inserted into the header and the partitioning member inside the header because the header includes the partitioning member therein. Consequently, the space inside the header to which the flat multi-hole tubes are connected is narrowed, and it is thus possible to sufficiently assure the speed of the refrigerant that passes through the space inside the header to which the flat multi-hole tubes are connected.

A heat exchanger according to an eighth example of one or more embodiments is similar to the heat exchanger according to the seventh example, and additionally the header has a loop structure. The loop structure of the header includes an inflow port, a first communication passage, and a second communication passage. The inflow port is an inflow port through which, when the heat exchanger functions as the refrigerant evaporator, the refrigerant is caused to flow into a first space, which is a space on the side where the flat multi-hole tubes are connected with respect to the partitioning member. The first communication passage is a passage via which a portion of the first space on a first side in the longitudinal direction of the header and a portion of a second space, which is a space on a side opposite to the side where the flat multi-hole tubes are connected with respect to the partitioning member, on the first side in the longitudinal direction of the header communicate with each other and through which a refrigerant that has flowed inside the first space is guided to the second space. The second communication passage is a passage through which a refrigerant that has flowed in the second space is returned to a second side, which is a side opposite to the first side in the longitudinal direction of the header, of the first space. At least a portion of the first space between the first communication passage and the second communication passage is formed so as to cause a larger amount of the refrigerant to flow on the upstream side than on the downstream side in the direction of the airflow.

Not limited to the portion between the first communication passage and the second communication passage, the entire first space may be formed so as to cause a larger amount of the refrigerant to flow on the upstream side than on the downstream side in the direction of the airflow.

In this heat exchanger, it is possible to reduce a sectional area in which the refrigerant that has flowed into the first space through the inflow port passes when flowing inside the first space, compared to a case in which the first space and the second space are not partitioned by the partitioning member, because the internal space of the header is partitioned by the partitioning member into the first space and the second space. Therefore, even when the circulation rate of the refrigerant in the heat exchanger is low, it is possible to cause the refrigerant that has flowed into the first space through the inflow port to pass through a narrow space, which is the first space only, and it is thus easy to cause the refrigerant to reach a side opposite to the inflow port in the internal space of the header without largely decreasing the passing speed of the refrigerant inside the first space. Therefore, even when the circulation rate of the refrigerant is low, it is possible to sufficiently supply the refrigerant also to the flat multi-hole tubes that are arranged far away from the inflow port.

In the heat exchanger, the header has the loop structure that includes the inflow port, the partitioning member, the first communication passage, and the second communication passage. Therefore, it is possible to return the refrigerant that has reached a position far from the inflow port in the first space to a position close to the inflow port in the first space again due to the loop structure even when, similarly to a case in which the circulation rate of the refrigerant in the heat exchanger is high, the flow speed of the refrigerant that flows into the first space through the inflow port is high and the refrigerant vigorously passes by the flat multi-hole tubes positioned close to the inflow port and tends to gather at a position far from the inflow port in the first space. In other words, the loop structure enables the refrigerant that has reached a position far from the inflow port in the first space to be sent toward the second space by passing through the first communication passage, to pass through the second space, to be sent toward a position close to the inflow port in the first space by passing through the second communication passage, and to be thereby guided to the flat multi-hole tubes present close to the inflow port in the first space. Therefore, it is possible to cause the refrigerant to flow sufficiently also into the flat multi-hole tubes close to the inflow port even when the flow speed of the refrigerant that flows into the first space through the inflow port is high, similarly to a case when the circulation rate is high, and the refrigerant thus vigorously passes by the flat multi-hole tubes positioned close to the inflow port and tends to gather at a position far from the inflow port in the first space.

Moreover, even when the refrigerant is caused to flow in a loop, as described above, inside the header, it is possible to hold a large amount of a liquid refrigerant on the windward side in a region between the first communication passage and the second communication passage because at least a portion between the first communication passage and the second communication passage of the partitioning member is formed so as to cause a larger amount of the refrigerant to flow on the upstream side than on the downstream side in the direction of the airflow.

A heat exchanger according to a ninth example of one or more embodiments is similar to the heat exchanger according to any of the first example to the eighth example, except that the plurality of flat multi-hole tubes are disposed in line in the up-down direction.

In this heat exchanger, the header is disposed in an orientation with which the longitudinal direction of the header is the up-down direction.

In this heat exchanger, it is possible to minimize a difference in state between the refrigerant that flows on the windward side and the refrigerant that flows on the leeward side in the flat multi-hole tubes even when the plurality of flat multi-hole tubes are disposed in line in the up-down direction.

In particular, when the plurality of flat multi-hole tubes are disposed in line in the up-down direction in the heat exchanger according to the eighth example, it is possible to reduce the sectional area in which the refrigerant that has flowed into the first space through the inflow port passes when ascending inside the first space, compared with a case in which the first space and the second space are not partitioned by the partitioning member, because the internal space of the header is partitioned by the partitioning member into the first space and the second space. Therefore, even when the circulation rate of the refrigerant in the heat exchanger is low, it is possible to cause the refrigerant that has flowed into the first space through the inflow port to ascend in a narrow space, which is the first space only. It is thus easy to cause the refrigerant to reach an upper portion of the internal space of the header without largely decreasing the ascending speed of the refrigerant inside the first space. Therefore, even when the circulation rate of the refrigerant is low, it is possible to supply the refrigerant sufficiently also into the flat multi-hole tubes arranged in the upper portion.

Moreover, in this heat exchanger, the header has the loop structure that includes the inflow port, the partitioning member, the first communication passage, and the second communication passage. Therefore, it is possible to return the refrigerant that has reached the upper portion of the first space, the refrigerant having a large specific gravity, to the lower portion of the first space again due to the loop structure even when the flow speed of the refrigerant that flows into the first space through the inflow port is high, similarly to a case in which the circulation rate of the refrigerant in the heat exchanger is high, the refrigerant thus vigorously passes by the flat multi-hole tubes positioned in a lower portion, and the refrigerant that has a large specific gravity tends to gather at an upper portion of the first space. In other words, the loop structure enables the refrigerant that has reached the upper portion of the first space to be sent toward the second space by passing through the first communication passage, to descend in the second space, to flow toward the lower portion of the first space by passing through the second communication passage, and to be thereby guided into the flat multi-hole tubes present in the lower portion of the first space. Therefore, it is possible to cause the refrigerant to flow sufficiently into the flat multi-hole tubes on the lower side even when the flow speed of the refrigerant that flows into the first space through the inflow port is high, similarly to a case in which the circulation rate is high, the refrigerant thus vigorously passes by the flat multi-hole tubes positioned in the lower portion, and the refrigerant that has a large specific gravity tends to gather at an upper portion of the first space.

An air conditioner according to a tenth example of one or more embodiments includes a refrigerant circuit and a fan. The refrigerant circuit includes the heat exchanger according to any of the first example to the ninth example and causes a refrigerant to circulate therein. The fan supplies an airflow to the heat exchanger.

In this air conditioner, it is possible to improve the performance of the heat exchanger by minimizing a difference in state between the refrigerant that flows on the windward side and the refrigerant that flows on the leeward side in the flat multi-hole tubes of the heat exchanger, and it is thus possible to improve the performance of the air conditioner.

In the heat exchanger according to the first example, it is possible to minimize a difference in state between the refrigerant that flows on the windward side and the refrigerant that flows on the leeward side in the flat multi-hole tubes without forming each of the flow paths of the flat multi-hole tubes so as to have a shape that greatly differs between the windward side and the leeward side.

In the heat exchanger according to the second example, it is easy to cause a refrigerant to flow on the windward side, where a pressure loss due to passage is relatively small.

In the heat exchanger according to the third example, it is possible to cause a refrigerant to flow on, in particular, the windward side of the space inside the header to which the flat multi-hole tubes are connected.

In the heat exchanger according to the fourth example, it is possible to minimize a difference in state between the refrigerant that flows on the windward side and the refrigerant that flows on the leeward side in the flat multi-hole tubes without forming each of the flow paths of the flat multi-hole tubes so as to have a shape that greatly differs between the windward side and the leeward side.

In the heat exchanger according to the fifth example, it is possible to improve pressure-resistance strength while suppressing the flat multi-hole tubes from being incorrectly assembled during manufacture.

In the heat exchanger according to the sixth example, it is possible to minimize a difference in state between the refrigerant that flows on the windward side and the refrigerant that flows on the leeward side in the flat multi-hole tubes even in a structure in which a heat exchange amount is increased more on the windward side than on the leeward side due to the arrangement of the fins.

In the heat exchanger according to the seventh example, it is possible to sufficiently assure the passing speed of the refrigerant by narrowing the space inside the header to which the flat multi-hole tubes are connected.

In the heat exchanger according to the eighth example, it is possible to hold a large amount of a liquid refrigerant on the windward side of the partitioning member in a region between the first communication passage and the second communication passage while suppressing unevenness in refrigerant flow between the flat multi-hole tubes that are arranged far from the inflow port and the flat multi-hole tubes that are arranged close to the inflow port.

In the heat exchanger according to the ninth example, it is possible to minimize a difference in state between the refrigerant that flows on the windward side and the refrigerant that flows on the leeward side in the flat multi-hole tubes even when the plurality of flat multi-hole tubes are disposed in line in the up-down direction.

In the air conditioner according to the tenth example, it is possible to improve the performance of the air conditioner.

DETAILED DESCRIPTION

(1) Overall Configuration of Air Conditioner 1

Figure 1:
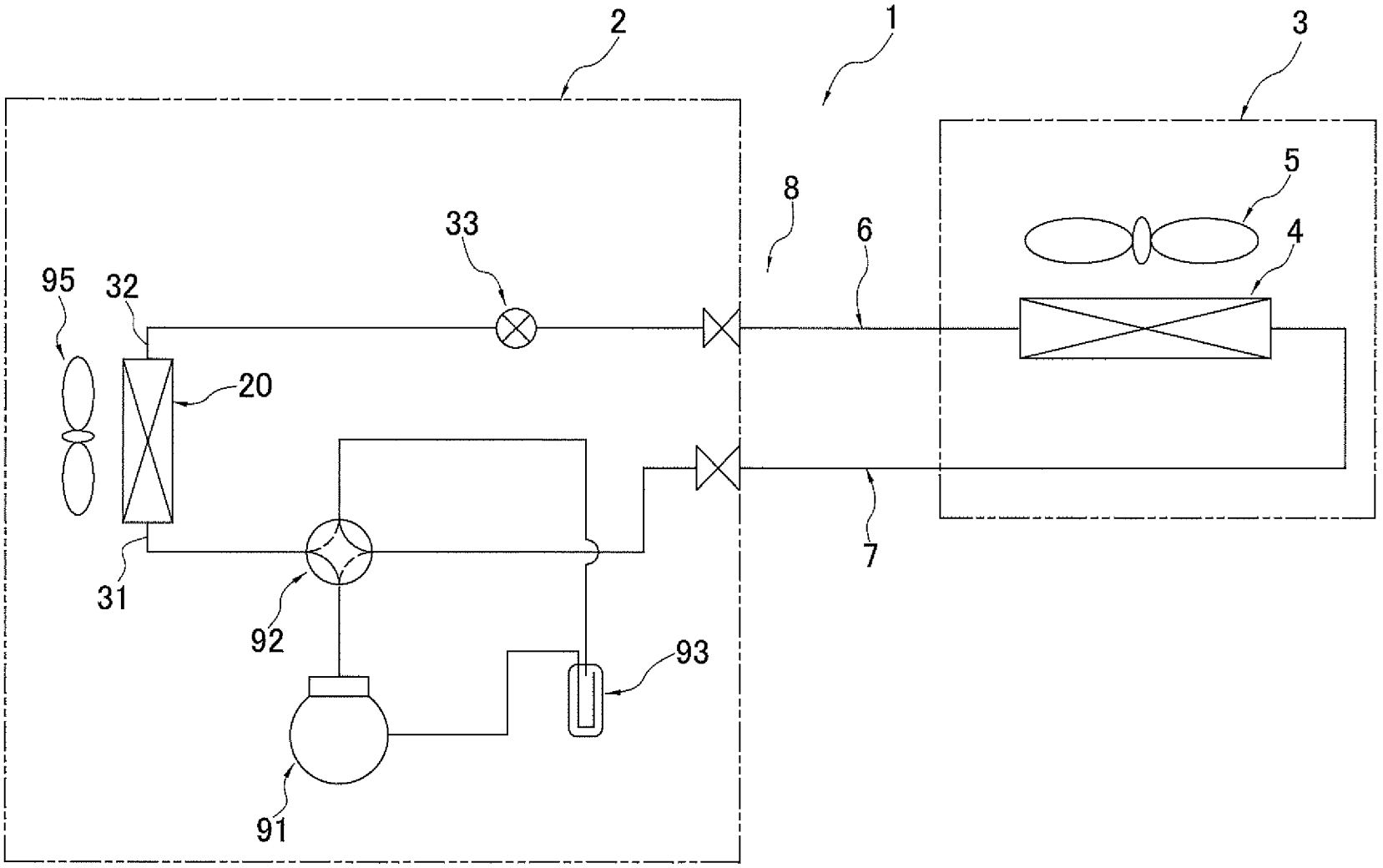
FIG. 1 is a circuit diagram for describing an overview of the structure of an air conditioner according to one or more embodiments.

FIG. 1 is a circuit diagram illustrating an overview of the configuration of an air conditioner 1 according to one or more embodiments of the present invention.

The air conditioner 1 is an apparatus for cooling and heating inside a building in which an air-conditioning indoor unit 3 is installed by performing a vapor-compression refrigeration cycle operation. The air conditioner 1 is constituted by an air-conditioning outdoor unit 2 as a heat-source-side unit, the air-conditioning indoor unit 3 as a use-side unit, and refrigerant connection pipes 6 and 7 that connect the air-conditioning outdoor unit 2 and the air-conditioning indoor unit 3 to each other.

A refrigerant circuit 8 including the air-conditioning outdoor unit 2, the air-conditioning indoor unit 3, and the refrigerant connection pipes 6 and 7 that are connected together is constituted by a compressor 91, a four-way switching valve 92, an outdoor heat exchanger 20, an expansion valve 33, an indoor heat exchanger 4, an accumulator 93, and the like that are connected together via refrigerant pipes. A refrigerant is enclosed inside the refrigerant circuit 8, and the refrigerant circuit 8 is configured such that a refrigerant cycle operation in which the refrigerant is compressed, cooled, decompressed, heated and evaporated, and then compressed again is performed. The refrigerant to be used is selected from, for example, R410A, R32, R407C, R22, R134a, carbon dioxide, and the like.

(2) Detailed Configuration of Air Conditioner 1

(2-1) Air-Conditioning Indoor Unit 3

The air-conditioning indoor unit 3 is installed at an indoor wall surface by, for example, being hooked thereon or installed at an indoor ceiling of a building or the like by, for example, being embedded therein or being hung therefrom. The air-conditioning indoor unit 3 includes an indoor heat exchanger 4 and an indoor fan 5. The indoor heat exchanger 4 is, for example, a fin-and-tube-type heat exchanger of a cross-fin type constituted by a heat transfer tube and a large number of fins. The indoor heat exchanger 4 functions as the refrigerant evaporator during a cooling operation to cool indoor air and functions as a refrigerant radiator or a refrigerant condenser during a heating operation to heat indoor air.

(2-2) Air-conditioning Outdoor Unit 2

Figure 2:
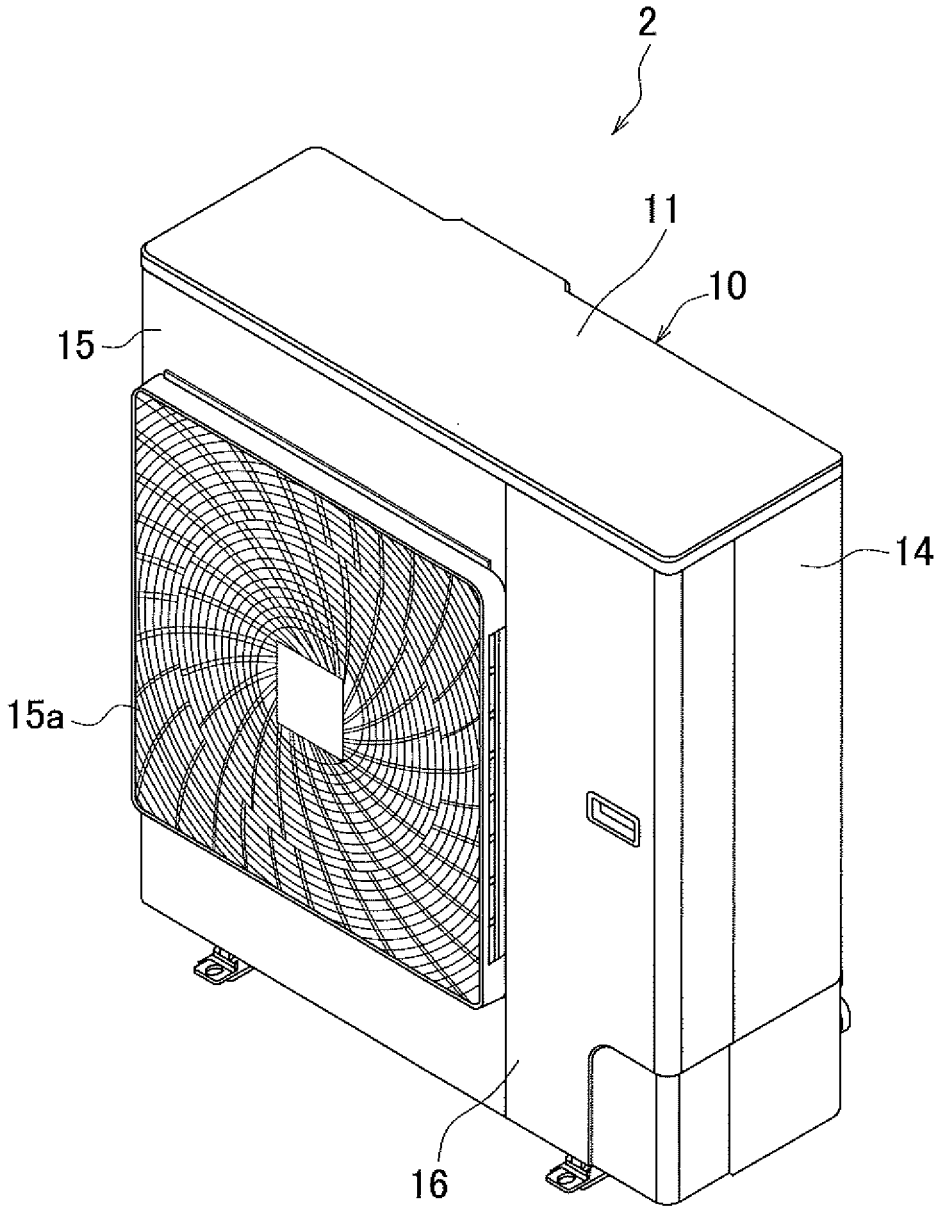
FIG. 2 is a perspective view illustrating an external appearance of an air-conditioning outdoor unit.
Figure 3:
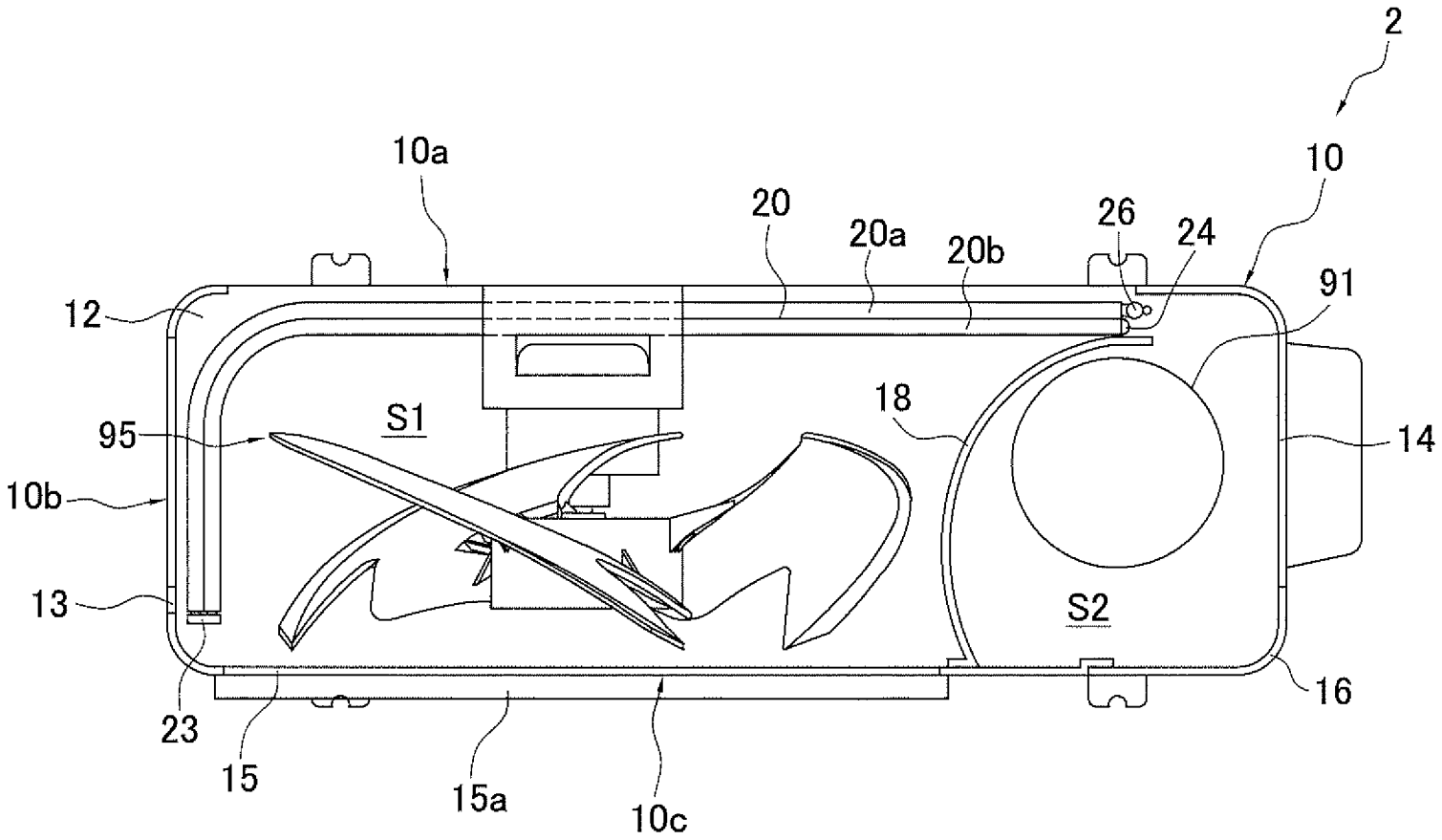
FIG. 3 is a schematic top sectional view for describing an arrangement of devices of the air-conditioning outdoor unit.

The air-conditioning outdoor unit 2 is installed outside a building or the like and connected to the air-conditioning indoor unit 3 via the refrigerant connection pipes 6 and 7. As illustrated in FIG. 2 and FIG. 3, the air-conditioning outdoor unit 2 includes a unit casing 10 having a substantially rectangular parallelepiped shape.

As illustrated in FIG. 3, the air-conditioning outdoor unit 2 has a structure (so-called trunk-type structure) that divides an internal space of the unit casing 10 by a vertically extending partition plate 18 into two spaces to thereby form a fan chamber S1 and a machine chamber S2. The air-conditioning outdoor unit 2 includes the outdoor heat exchanger 20 and an outdoor fan 95 that are arranged inside the fan chamber S1 of the unit casing 10 and the compressor 91, the four-way switching valve 92, the accumulator 93, the expansion valve 33, a gas refrigerant pipe 31, and a liquid refrigerant pipe 32 that are arranged inside the machine chamber S2 of the unit casing 10.

The unit casing 10 includes a bottom plate 12, a top plate 11, a fan-chamber-side side plate 13, a machine-chamber-side side plate 14, a fan-chamber-side front plate 15, and a machine-chamber-side front plate 16, thereby constituting a case.

The air-conditioning outdoor unit 2 is configured to take outdoor air from the rear surface and portion of the side surfaces of the unit casing 10 into the fan chamber S1 inside the unit casing 10 and blow out the taken-in outdoor air from the front surface of the unit casing 10. Specifically, an intake port 10*a*, an intake port 10*b*, and a blow-out port 10*c* are formed with respect to the fan chamber S1 inside the unit casing 10. An entire intake port including the intake port 10*a* and the intake port 10*b* extends from an end portion of the fan-chamber-side side plate 13 on the front surface side to an end portion of the machine-chamber-side side plate 14 on the side of the fan chamber S1. The blow-out port 10*c* is provided in the fan-chamber-side front plate 15, and the front side thereof is covered by a fan grille 15*a*.

The compressor 91 is, for example, a hermetic compressor that is driven by a compressor motor and is configured to be capable of varying operating capacity by being inverter-controlled. It is possible to respond to a fluctuation in an air-conditioning load by thus varying the operating capacity.

The four-way switching valve 92 is a mechanism for switching the flowing direction of a refrigerant. During cooling operation, the four-way switching valve 92 connects the refrigerant pipe on the discharge side of the compressor 91 and the gas refrigerant pipe 31 extending from one end (gas-side end portion) of the outdoor heat exchanger 20 to each other and connects the refrigerant connection pipe 7 for a gas refrigerant and the refrigerant pipe on the intake side of the compressor 91 to each other via the accumulator 93 (refer to the solid lines of the four-way switching valve 92 in FIG. 1). During heating operation, the four-way switching valve 92 connects the refrigerant pipe on the discharge side of the compressor 91 and the refrigerant connection pipe 7 for the gas refrigerant to each other and connects the intake side of the compressor 91 and the gas refrigerant pipe 31 extending from one end (gas-side end portion) of the outdoor heat exchanger 20 to each other via the accumulator 93 (refer to the broken lines of the four-way switching valve 92 in FIG. 1).

The outdoor heat exchanger 20 is arranged to stand in an up-down direction (vertical direction) so as to face the intake ports 10*a* and 10*b* in the fan chamber S1. The outdoor heat exchanger 20 is a heat exchanger made of aluminum. In one or more embodiments, a heat exchanger that has a design pressure of approximately 3 MPa to 4 MPa is used. The gas refrigerant pipe 31 extends from one end (gas-side end portion) of the outdoor heat exchanger 20 so as to be connected to the four-way switching valve 92. In addition, the liquid refrigerant pipe 32 extends from the other end (liquid-side end portion) of the outdoor heat exchanger 20 so as to be connected to the expansion valve 33.

The accumulator 93 is connected to an intermediate portion of the refrigerant circuit 8 between the four-way switching valve 92 and the compressor 91. The accumulator 93 has a gas-liquid separating function of separating a refrigerant into a gas-phase refrigerant and a liquid-phase refrigerant. A refrigerant that flows into the accumulator 93 is separated into a liquid-phase refrigerant and a gas-phase refrigerant, and the gas-phase refrigerant that gathers in an upper space is supplied to the compressor 91.

The expansion valve 33 is a mechanism for decompressing a refrigerant that flows in the refrigerant circuit 8 and is an electric valve that is adjustable in terms of an opening degree. The expansion valve 33 is disposed between the outdoor heat exchanger 20 and the refrigerant connection pipe 6 for a liquid refrigerant to adjust the pressure and the flow rate of the refrigerant. The expansion valve 33 has a function of expanding the refrigerant during both the cooling operation and the heating operation.

The outdoor fan 95 supplies outdoor air that is for exchanging heat with the refrigerant that flows through the outdoor heat exchanger 20 to the outdoor heat exchanger 20. The outdoor fan 95 is arranged in the fan chamber S1 so as to face the outdoor heat exchanger 20. The outdoor fan 95 takes outdoor air from the rear surface side into the unit, causes a heat exchange between the outdoor air and the refrigerant in the outdoor heat exchanger 20, and then discharges the air after the heat exchange to the outside of the unit from the front surface side. The outdoor fan 95 is a fan that is capable of varying the airflow volume of the outdoor air to be supplied to the outdoor heat exchanger 20. The outdoor fan 95 is, for example, a propeller fan or the like that is driven by a motor constituted by a DC fan motor and the like.

(3) Operation of Air Conditioner 1

(3-1) Cooling Operation

During cooling operation, the four-way switching valve 92 is in the state indicated by the solid lines in FIG. 1, that is, in a state in which the discharge side of the compressor 91 is connected to the gas side of the outdoor heat exchanger 20 via the gas refrigerant pipe 31 and in which the intake side of the compressor 91 is connected to the gas side of the indoor heat exchanger 4 via the accumulator 93 and the refrigerant connection pipe 7. The opening degree of the expansion valve 33 is adjusted (superheating control) such that the degree of superheating of the refrigerant at an outlet of the indoor heat exchanger 4 (that is, the gas side of the indoor heat exchanger 4) is constant. When the compressor 91, the outdoor fan 95, and the indoor fan 5 are operated with the refrigerant circuit 8 in this state, a low-pressure gas refrigerant becomes a high-pressure gas refrigerant by being compressed by the compressor 91. The high-pressure gas refrigerant is sent to the outdoor heat exchanger 20 via the four-way switching valve 92. The high-pressure gas refrigerant then exchanges heat with outdoor air supplied by the outdoor fan 95 and condenses into a high-pressure liquid refrigerant in the outdoor heat exchanger 20. The high-pressure liquid refrigerant in a subcooled state is sent to the expansion valve 33 from the outdoor heat exchanger 20. The refrigerant that has entered a low-pressure gas-liquid two-phase state by being decompressed by the expansion valve 33 to a pressure approximate to an intake pressure of the compressor 91 is sent to the indoor heat exchanger 4, exchanges heat with indoor air in the indoor heat exchanger 4, and becomes a low-pressure gas refrigerant by evaporating.

The low-pressure gas refrigerant is sent to the air-conditioning outdoor unit 2 via the refrigerant connection pipe 7 and taken into the compressor 91 again. Thus, during cooling operation, the air conditioner 1 causes the outdoor heat exchanger 20 to function as a condenser for a refrigerant to be compressed in the compressor 91 and causes the indoor heat exchanger 4 to function as an evaporator for a refrigerant condensed in the outdoor heat exchanger 20.

In the refrigerant circuit 8 during cooling operation, the compressor 91 is inverter-controlled so as to have a set temperature (so as to be enabled to process a cooling load) while the superheating control of the expansion valve 33 is performed. Consequently, there are a case in which the circulation rate of the refrigerant is high and a case in which the circulation rate of the refrigerant is low.

(3-2) Heating Operation

During heating operation, the four-way switching valve 92 is in the state indicated by the broken lines in FIG. 1, that is, in a state in which the discharge side of the compressor 91 is connected to the gas side of the indoor heat exchanger 4 via the refrigerant connection pipe 7 and in which the intake side of the compressor 91 is connected to the gas side of the outdoor heat exchanger 20 via the gas refrigerant pipe 31. The opening degree of the expansion valve 33 is adjusted (subcooling control) such that the degree of subcooling of the refrigerant at the outlet of the indoor heat exchanger 4 is constant at a subcooling target value. When the compressor 91, the outdoor fan 95, and the indoor fan 5 are operated with the refrigerant circuit 8 in this state, a low-pressure gas refrigerant becomes a high-pressure gas refrigerant by being taken into and compressed by the compressor 91 and is sent to the air-conditioning indoor unit 3 via the four-way switching valve 92 and the refrigerant connection pipe 7.

The high-pressure gas refrigerant sent to the air-conditioning indoor unit 3 is decompressed in accordance with the valve opening degree of the expansion valve 33, after exchanging heat with indoor air and condensing into a high-pressure liquid refrigerant in the indoor heat exchanger 4, when passing through the expansion valve 33. The refrigerant that has passed through the expansion valve 33 flows into the outdoor heat exchanger 20. The low-pressure refrigerant that has flowed into the outdoor heat exchanger 20 and that is in the gas-liquid two-phase state exchanges heat with outdoor air supplied by the outdoor fan 95, becomes a low-pressure gas refrigerant by evaporating, and is taken into the compressor 91 again via the four-way switching valve 92. Thus, during heating operation, the air conditioner 1 causes the indoor heat exchanger 4 to function as a condenser for the refrigerant to be compressed in the compressor 91 and causes the outdoor heat exchanger 20 to function as an evaporator for the refrigerant condensed in the indoor heat exchanger 4.

In the refrigerant circuit 8 during heating operation, the compressor 91 is inverter-controlled so as to have a set temperature (so as to be enabled to process a heating load) while the subcooling control of the expansion valve 33 is performed. Consequently, there are a case in which the circulation rate of the refrigerant is high and a case in which the circulation rate of the refrigerant is low.

(4) Detailed Configuration of Outdoor Heat Exchanger 20

(4-1) Overall Configuration of Outdoor Heat Exchanger 20

Figure 4:
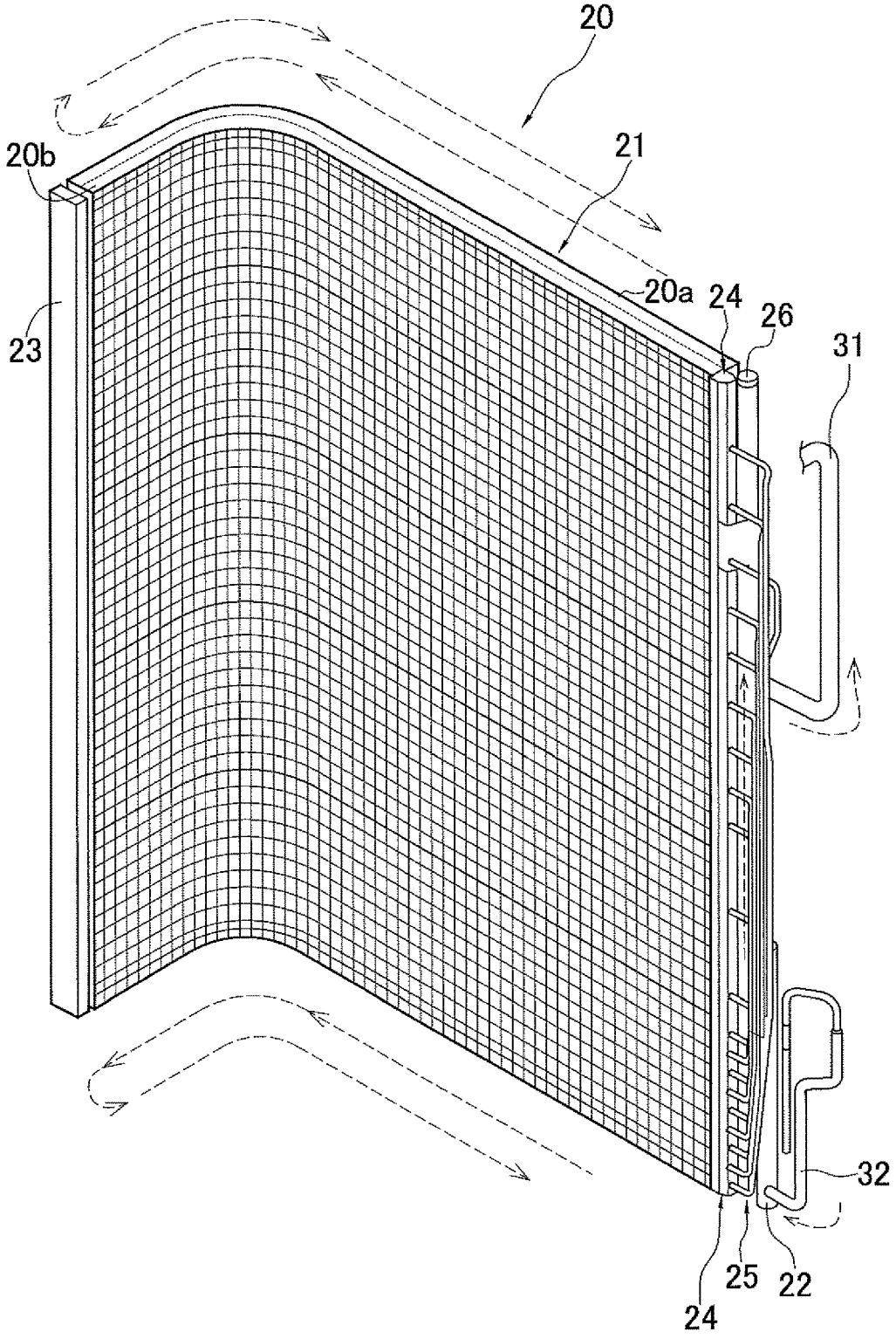
FIG. 4 is a schematic perspective view illustrating an external appearance of an outdoor heat exchanger.
Figure 5:
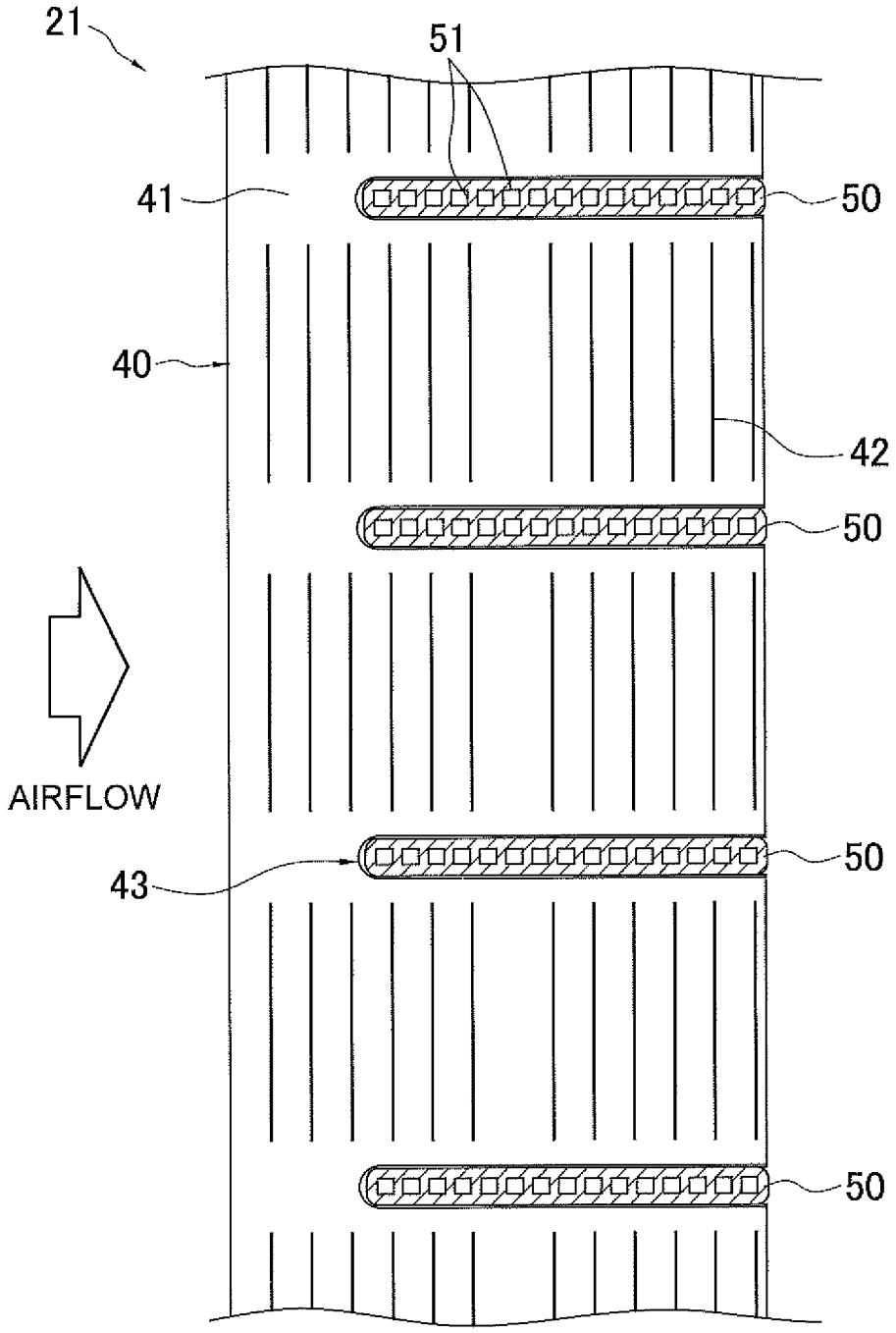
FIG. 5 is a schematic view illustrating an attached state of heat transfer fins with respect to flat multi-hole tubes in the outdoor heat exchanger.

A schematic perspective view of the external appearance of the outdoor heat exchanger 20 is illustrated in FIG. 4. An attached state of a heat transfer fin 40 with respect to flat multi-hole tubes 50 as viewed in a refrigerant passing direction in each internal flow path 51 of the flat multi-hole tubes 50 is illustrated in FIG. 5.

The outdoor heat exchanger 20 includes heat exchanging portion 21 that cause a heat exchange between outdoor air and a refrigerant, an entrance header tube 26 and a return header 24 that are disposed on one end side of the heat exchanging portion 21, a coupling header 23 disposed on the other end side of the heat exchanging portion 21, a connection portion 25 that couples a lower portion of the return header 24 and an upper portion of the return header 24, and a distributor 22 that guides a distributed refrigerant to a lower portion of the entrance header tube 26.

(4-2) Heat Exchanging Portion 21

The heat exchanging portion 21 are constituted by a large number of heat transfer fins 40 and a large number of flat multi-hole tubes 50. The heat transfer fins 40 and the flat multi-hole tubes 50 are each made of aluminum or an aluminum alloy.

As illustrated in FIG. 5, the heat transfer fins 40 are flat plate members and extend in the up-down direction and in an airflow direction. A plurality of the heat transfer fins 40 are disposed in line in a plate-thickness direction. Each of the heat transfer fins 40 is provided with openings 43, which are cutouts for inserting flat tubes. The openings 43 extend horizontally from a downstream side end portion and stop before reaching an upstream side end portion in the airflow direction. The heat transfer fins 40 each include a plurality of the openings 43. The plurality of openings 43 are provided in line in the up-down direction in the heat transfer fins 40. The heat transfer fins 40 have windward communication portions 41 that are connected to each other in the up-down direction on the upstream side of the flat multi-hole tubes 50 in the airflow direction. The heat transfer fins 40 do not have communication portions connected to each other in the up-down direction on the leeward side of the flat multi-hole tubes 50. The heat transfer fins 40 thus are not connected to each other on the leeward side. Consequently, each of the flat multi-hole tubes 50 to which the heat transfer fins 40 are fixed has a structure in which a heat exchange amount of a refrigerant that flows through, of the plurality of internal flow paths 51, the internal flow paths 51 on the windward side is larger than that of a refrigerant that flows through the internal flow paths 51 on the leeward side. In the airflow direction, downstream-side end portions of the heat transfer fins 40 are aligned with downstream-side end portions of the flat multi-hole tubes 50. The heat transfer fins 40 have slits 42 that are provided in line in the airflow direction, the slits 42 extending in the up-down direction between the flat multi-hole tubes 50 and passing through in the plate-thickness direction. No slit 42 is provided in a portion of each of the windward communication portions 41 at the same height as the height at which respective flat multi-hole tube 50 is disposed.

As described above, the windward communication portions 41 of the heat transfer fins 40 are provided on the windward side of the flat multi-hole tubes 50. Therefore, when the outdoor heat exchanger 20 is used as the refrigerant evaporator, it is possible to cause frost to adhere also to the windward communication portions 41 of the heat transfer fins 40, and it is thus possible to suppress airflow resistance from increasing shortly as a result of frost adhering concentratively to the windward-side end portions of the flat multi-hole tubes 50.

The flat multi-hole tubes 50 function as heat transfer tubes and transmit heat that is transferred between the heat transfer fins 40 and outdoor air to a refrigerant that flows inside the flat multi-hole tubes 50. The flat multi-hole tubes 50 each have upper and lower flat surface portions that serve as heat transfer surfaces extending in the horizontal direction and a plurality of the internal flow paths 51 that cause a refrigerant to flow between the flat surface portions in the longitudinal direction of the flat multi-hole tubes 50. The plurality of internal flow paths 51 of each of the flat multi-hole tubes 50 are arranged in line in the flow direction of air that passes through the outdoor heat exchanger 20. The flat multi-hole tubes 50 each have the shape that is symmetrical between the upstream side and the downstream side with a border at an intermediate position in the airflow direction. Therefore, it is possible to suppress the flat multi-hole tubes 50 from being incorrectly directed during assembling of the outdoor heat exchanger 20. The internal flow paths 51 have a common flow-path sectional area. As described above, the internal flow paths 51 of the flat multi-hole tubes 50 do not include a mix of an internal flow path that has a large flow-path sectional area and an internal flow path that has a small flow-path sectional area, and the internal flow paths 51 have the common flow-path sectional area. Accordingly, it is possible to cause the pressure to be applied by the refrigerant that flows through the internal flow paths 51 to be equal among all the internal flow paths 51. Therefore, it is possible to increase the pressure-resistance strength of the flat multi-hole tubes 50. A plurality of the flat multi-hole tubes 50 each having such a shape are provided so as to be arranged with a predetermined interval therebetween in the vertical direction.

In the direction of an airflow (flow from the rear surface side and the left side of the case toward the fan grille 15*a* of the front surface of the case) generated by the outdoor fan 95, the heat exchanging portion 21 each include a windward-side heat exchanging portion 20*a* provided so as to fringe a windward portion and a leeward-side heat exchanging portion 20*b* provided so as to fringe a leeward side. The windward-side heat exchanging portion 20*a* and the leeward-side heat exchanging portion 20*b* are arranged in line in two rows in the airflow direction.

The windward-side heat exchanging portion 20*a* includes a plurality of the flat multi-hole tubes 50 that extend so as to fringe the windward side and that are arranged in line in the up-down direction and the heat transfer fins 40 that are fixed to the flat multi-hole tubes 50. Similarly, the leeward-side heat exchanging portion 20*b* also includes a plurality of the flat multi-hole tubes 50 that extend so as to fringe the leeward side and that are arranged in line in the up-down direction and the heat transfer fins 40 that are fixed to the flat multi-hole tubes 50.

(4-3) Distributor 22

The distributor 22 is connected so as to couple the liquid refrigerant pipe 32 and a lower portion of the entrance header tube 26. The distributor 22 distributes, for example, a refrigerant that flows from the liquid refrigerant pipe 32 in a height direction when the outdoor heat exchanger 20 functions as the refrigerant evaporator. Each flow of the refrigerant thus distributed by the distributor 22 is guided to a respective height position in the lower portion of the entrance header tube 26.

(4-4) Entrance Header Tube 26

The entrance header tube 26 is a cylindrical member that extends in the vertical direction and that is made of aluminum or an aluminum alloy, and an inner portion of the entrance header tube 26 is divided into an upper portion and a lower portion. Specifically, the inner portion of the entrance header tube 26 is partitioned in the up-down direction by baffles extending in the horizontal direction.

The lower portion of the entrance header tube 26 functions as a refrigerant inlet when the outdoor heat exchanger 20 functions as the refrigerant evaporator, and the lower portion of the entrance header tube 26 functions as a refrigerant outlet when the outdoor heat exchanger 20 functions as the refrigerant radiator. The upper portion of the entrance header tube 26 functions as a refrigerant outlet when the outdoor heat exchanger 20 functions as the refrigerant evaporator, and the upper portion of the entrance header tube 26 functions as a refrigerant inlet when the outdoor heat exchanger 20 functions as the refrigerant radiator.

The lower portion of the entrance header tube 26 is connected to the liquid refrigerant pipe 32 via the distributor 22. The upper portion of the entrance header tube 26 is connected to the gas refrigerant pipe 31.

The lower portion of the entrance header tube 26 has a plurality of spaces in line in the up-down direction such that the distribution of the refrigerant distributed by the distributor 22 in the height direction is maintained when the outdoor heat exchanger 20 functions as the evaporator. These spaces are demarked by a plurality of baffles partitioning the internal space of the lower portion of the entrance header tube 26 in the up-down direction. Thus, these spaces are formed so as to enable each flow of the refrigerant distributed in the height direction by the distributor 22 to be sent to the heat exchanging portion 21 via the lower portion of the entrance header tube 26 while maintaining the distributed state thereof.

According to the above configuration, when the outdoor heat exchanger 20 functions as the refrigerant evaporator, the refrigerant that flows into the heat exchanging portion 21 via the liquid refrigerant pipe 32, the distributor 22, and the lower portion of the entrance header tube 26 evaporates while passing through each of the members described below and reaches the upper portion of the entrance header tube 26. The evaporated refrigerant flows out to the outside of the outdoor heat exchanger 20 via the upper portion of the entrance header tube 26 and the gas refrigerant pipe 31. When the outdoor heat exchanger 20 functions as the refrigerant radiator, the refrigerant flows in a direction opposite to the direction described above.

(4-5) Coupling Header 23

In the outdoor heat exchanger 20, the coupling header 23 is disposed on a side (the side of the fan chamber in FIG. 3) of the heat exchanging portion 21 opposite to an end portion on the side (the side of machine chamber in FIG. 3) where the entrance header tube 26 and the return header 24 are disposed.

The coupling header 23 is formed so as to guide a refrigerant that has flowed through the flat multi-hole tubes 50 of the windward-side heat exchanging portion 20*a* to the flat multi-hole tubes 50 of the leeward-side heat exchanging portion 20*b* at the same height position or so as to guide a refrigerant that has flowed through the flat multi-hole tubes 50 of the leeward-side heat exchanging portion 20*b* to the flat multi-hole tubes 50 of the windward-side heat exchanging portion 20*a* at the same height position. Here, the flowing direction of the refrigerant that flows through a portion of the coupling header 23 at a height position corresponding to the lower portion of the entrance header tube 26 and the flowing direction of the refrigerant that flows through a portion of the coupling header 23 at a height position corresponding to the upper portion of the entrance header tube 26 are opposite to each other.

The coupling header 23 does not cause movement of the refrigerant in the up-down direction and plays a role of simply connecting the flow paths of the refrigerant at the same height positions in the outdoor heat exchanger 20.

(4-6) Return Header 24

The return header 24 is disposed at the end portion of the heat exchanging portion 21 opposite to the end portion thereof where the coupling header 23 is disposed so as to extend in the up-down direction on the downstream side of the entrance header tube 26. The return header 24 is connected to an end portion of the leeward-side heat exchanging portion 20*b* of the heat exchanging portion 21 on a side opposite to the side of the coupling header 23. The return header 24 is also a member made of aluminum or an aluminum alloy.

Figure 6:
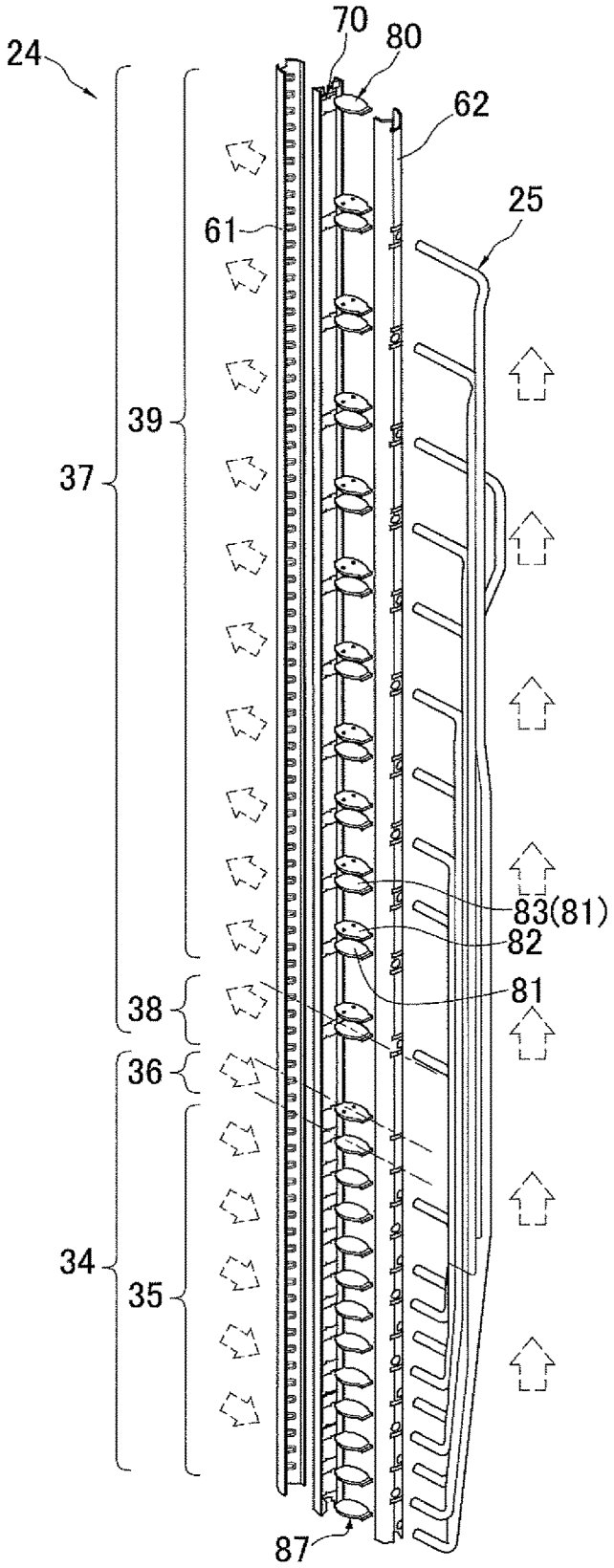
FIG. 6 is an exploded schematic perspective view of a return header and a connection portion.

As illustrated in the exploded schematic perspective view of the return header 24 and the connection portion 25 in FIG. 6, the return header 24 includes a multi-hole-side member 61 to which one end of each of the plurality of flat multi-hole tubes 50 is connected, a pipe-side member 62 constituting a side opposite to the side to which the flat multi-hole tubes 50 are connected, a partitioning member 70 positioned between the multi-hole-side member 61 and the pipe-side member 62, and a plurality of baffles 80 partitioning a space inside the return header 24 in the up-down direction. In FIG. 6, an illustration of openings that are provided in the partitioning member 70 and that are for inserting the baffles 80 and an illustration of a concave-convex shaped portion 88 that is provided on the partitioning member 70 are omitted.

The return header 24 is a vertically long structure constituted by an assembly of the plurality of these members. In the return header 24, members other than the partitioning member 70 are fixed mainly to the partitioning member 70, which is a single component, and therefore, positioning among these members is easy and the strength is easily assured. It is thus possible to easily manufacture the return header 24 even when the structure thereof is vertically long.

The multi-hole-side member 61 constitutes a wall surface of the return header 24 on the side of the heat exchanging portion 21, and, in a top view, the multi-hole-side member 61 has a substantially semicircular arc shape that has the center of circle on a side opposite to the side where the flat multi-hole tubes 50 are connected. The semicircular arc shape of the multi-hole-side member 61 extends in the up-down direction, and a plurality of openings that are for inserting one end of each of the flat multi-hole tubes 50 and that pass through in the plate-thickness direction are provided at respective height positions in the multi-hole-side member 61.

The pipe-side member 62 constitutes a wall surface of the return header 24 on a side opposite to the side of the heat exchanging portion 21, and, in the top view, the pipe-side member 62 has a substantially semicircular arc shape that has the center of circle on the side where the flat multi-hole tubes 50 are connected. The semicircular arc shape of the pipe-side member 62 extends in the up-down direction. A plurality of openings that are for inserting connection pipes of the connection portion 25, which will be described later, and that pass through in the plate-thickness direction are provided at respective height positions in the pipe-side member 62. In addition, openings for fixing one end side of each of the baffles 80 are provided at respective height positions in the pipe-side member 62.

The partitioning member 70 extends in the front-rear direction (airflow direction) and in the up-down direction so as to partition the space inside the return header 24 into a space (first space) on the side of the multi-hole-side member 61 and a space (second space) on the side of the pipe-side member 62. Openings for inserting and fixing the baffles 80 are provided at respective height positions in the partitioning member 70.

Figure 7:
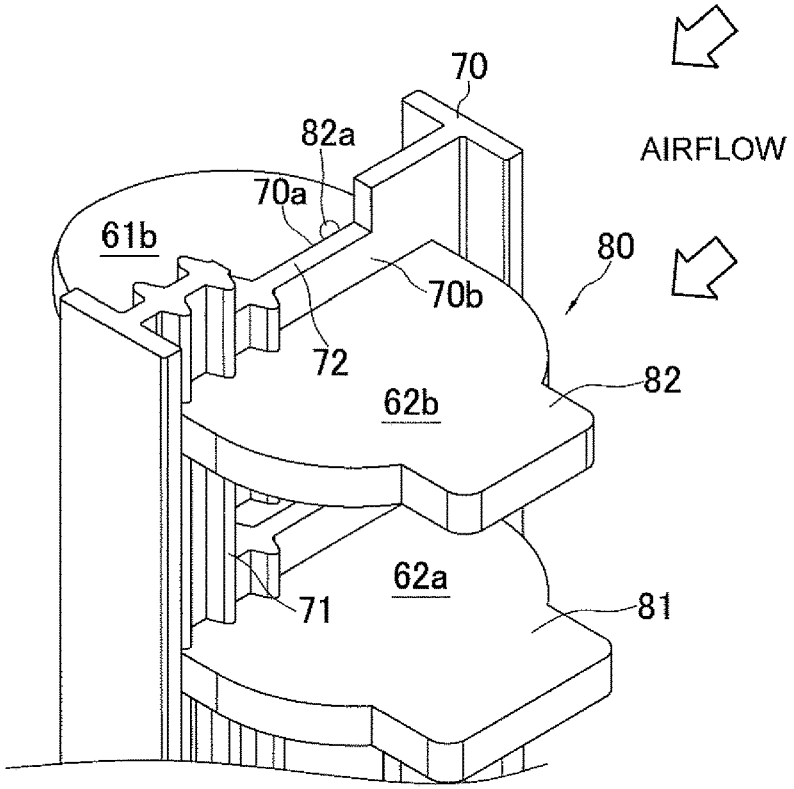
FIG. 7 is a schematic perspective view of an assembly of a partitioning member and baffles in a state in which the partitioning member is cut at a lower communication passage.

FIG. 7 is a schematic perspective view of an assembled state of the partitioning member 70 that is cut in the vicinity of a lower communication passage 72 in the horizontal direction and the baffles 80.

Figure 8:
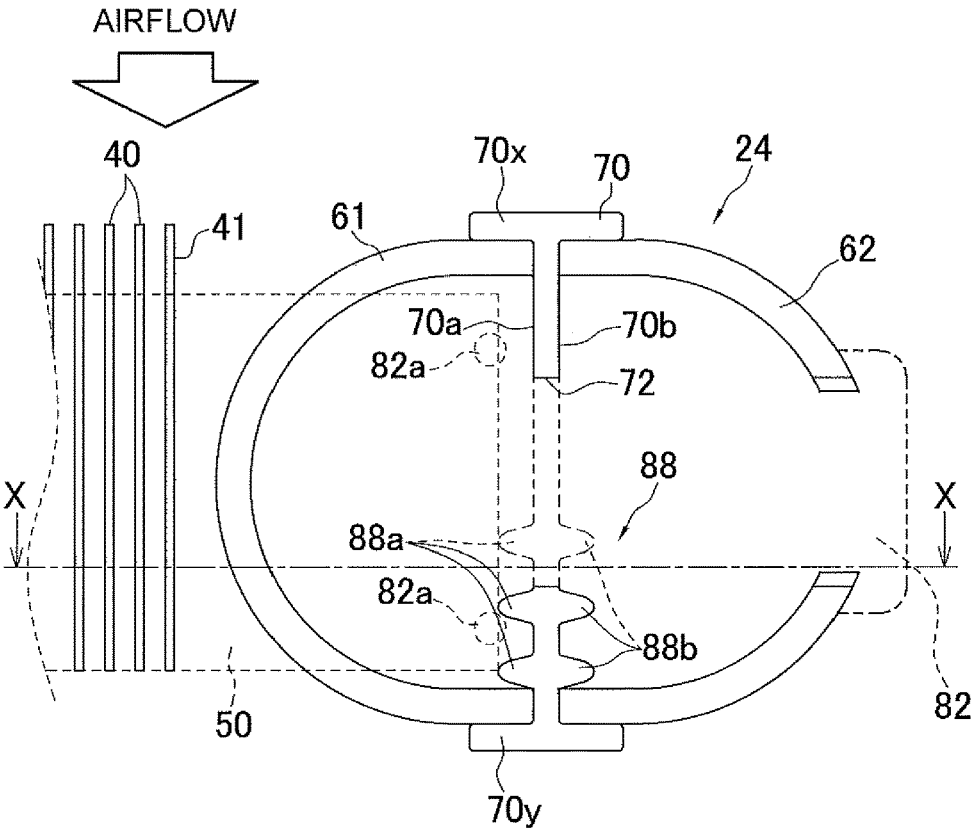
FIG. 8 is a top view of an assembly of a rectifying plate, a multi-hole-side member, a pipe-side member, and the partitioning member.

FIG. 8 is a top view of an assembled state of a rectifying plate 82 of the baffles 80, the multi-hole-side member 61, the pipe-side member 62, and the partitioning member 70.

As illustrated in FIG. 7 and FIG. 8, the partitioning member 70 includes an upstream end portion 70*x* that extends at an upstream-side end portion in the airflow direction with the upstream side in the airflow direction as the normal direction and a downstream end portion 70*y* that extends at a downstream-side portion in the airflow direction with the downstream side in the airflow direction as the normal direction. The upstream end portion 70*x* and the downstream end portion 70*y* extend, mainly in the up-down direction, in the longitudinal direction of the return header 24 and hold the multi-hole-side member 61 and the pipe-side member 62 from the upstream side and the downstream side in the airflow direction. Here, a structure capable of fixing both the multi-hole-side member 61 and the pipe-side member 62 to the partitioning member 70 is employed, which enables easy manufacture while increasing the structural strength of the return header 24.

On the upstream side of the center of the partitioning member 70 in the airflow direction, the partitioning member 70 has a multi-hole-side surface 70*a*, which is a surface on the side of the multi-hole-side member 61, and a pipe-side surface 70*b*, which is a surface on the side of the pipe-side member 62. The multi-hole-side surface 70*a* and the pipe-side surface 70*b* each extend in a flat shape in the front-rear direction and in the up-down direction.

On the downstream side of the center of the partitioning member 70 in the airflow direction, the partitioning member 70 is provided with the concave-convex shaped portion 88 including convex portions that project in the plate-thickness direction of the partitioning member 70 (the longitudinal direction of the flat multi-hole tubes 50 in which the flat multi-hole tubes 50 are inserted) and oppositely-recessed concave portions. The concave-convex shaped portion 88 has a multi-hole-side concave-convex portion 88*a* that includes portions projecting toward the multi-hole-side member 61 and a pipe-side concave-convex portion 88*b* that includes portions projecting toward the pipe-side member 62. Here, the multi-hole-side concave-convex portion 88*a* includes a plurality of convex portions that project toward the flat multi-hole tubes 50 and concave portions between the convex portions, the convex portions and the concave portions extending in the up-down direction. A projecting-direction tip portion of each of the convex portions of the multi-hole-side concave-convex portion 88*a* projecting toward the multi-hole-side member 61 may be in contact with end portions of the inserted flat multi-hole tubes 50 or may be separated from the end portions of the flat multi-hole tubes 50 with a slight gap therebetween. The pipe-side concave-convex portion 88*b* has a shape that is symmetrical to that of the multi-hole-side concave-convex portion 88*a*. The pipe-side concave-convex portion 88*b* includes a plurality of convex portions that project toward a side opposite to the flat multi-hole tubes 50 and concave portions between the convex portions, the convex portions and the concave portions extending in the up-down direction.

As described above, at a portion of the partitioning member 70 facing the end portions of the flat multi-hole tubes 50 inserted into the return header 24, the multi-hole-side surface 70*a* extending in the flat shape is provided on the upstream side of the center in the airflow direction, and the multi-hole-side concave-convex portion 88*a* is provided on the downstream side of the center in the airflow direction. Therefore, in a space (a first introducing space 61*a* and an ascending space 61*b*, which will be described later) between the partitioning member 70 and the multi-hole-side member 61, a space between the partitioning member 70 and each of the flat multi-hole tubes 50 is formed so as to be larger on the upstream side than on the downstream side in the airflow direction when viewed in the longitudinal direction of the return header 24. Consequently, in the space between the partitioning member 70 and each of the flat multi-hole tubes 50, a refrigerant that passes on the leeward side in the up-down direction is subjected to a larger pressure loss than a refrigerant that passes on the windward side in the up-down direction. Accordingly, in the space between the partitioning member 70 and each of the flat multi-hole tubes 50, a larger amount of a refrigerant flows on the upstream side than on the downstream side in the airflow direction.

As a result of the end portions of the flat multi-hole tubes 50 being connected so as to enter inside the return header 24, an area corresponding to, of the space between the partitioning member 70 and the multi-hole-side member 61, a portion excluding the flat multi-hole tubes 50 is smaller than an area corresponding to a space between the partitioning member 70 and the pipe-side member 62, when viewed in the vertical direction, which is the direction in which the return header 24 extends.

A plurality of openings that pass through in the plate-thickness direction (the longitudinal direction of the flat multi-hole tubes 50 in which the flat multi-hole tubes 50 are inserted) are formed in the partitioning member 70 so as to be in line in the up-down direction. The plurality of openings are grouped into openings for inserting and fixing the baffles 80, opening for constituting an upper communication passage 73, openings for constituting the lower communication passage 72, opening for constituting an introducing communication port 71, and openings for constituting a pressure equalization opening 74. The upper communication passage 73, the lower communication passage 72, the introduction communication port 71, and the pressure equalization opening 74 will be described later. The concave-convex shaped portion 88 provided in the partitioning member 70 so as to extend in the up-down direction is not provided at the openings for inserting the baffles 80, the upper communication passage 73, the lower communication passage 72, the introducing communication port 71, and the pressure equalization opening 74, and thus is discontinuous.

A leeward-side end portion of the multi-hole-side member 61 is fixed by being held in the airflow direction from the upstream side in the airflow direction by the convex portion of the multi-hole-side concave-convex portion 88*a* on the leeward-most side and from the downstream side in the airflow direction by the downstream end portion 70*y* of the partitioning member 70. Similarly, a leeward-side end portion of the pipe-side member 62 is fixed by being held in the airflow direction from the upstream side in the airflow direction by the convex portion of the pipe-side concave-convex portion 88*b* on the leeward-most side and from the downstream side in the airflow direction by the downstream end portion 70*y* of the partitioning member 70.

As illustrated in FIG. 6, an internal space of the return header 24 is divided in the up-down direction into a lower return portion 34 on the lower side and an upper return portion 37 on the upper side.

An internal space of the lower return portion 34 is further divided in the up-down direction into a first lower return portion 35 on the lower side and a second lower return portion 36 on the upper side.

An internal space of the upper return portion 37 is also divided in the up-down direction into a first upper return portion 38 on the lower side and a second upper return portion 39 on the upper side.

When the outdoor heat exchanger 20 functions as the refrigerant evaporator, a refrigerant that flows from the heat exchanging portion 21 into the first lower return portion 35 is sent to the second upper return portion 39 via the connection pipes of the connection portion 25, which will be described later, and a refrigerant that flows from the heat exchanging portion 21 into the second lower return portion 36 is sent to the first upper return portion 38 via the space inside the return header 24, not via the connection portion 25. The refrigerant sent to the second upper return portion 39 or the first upper return portion 38 is then sent to the heat exchanging portion 21 again.

Here, the number of the flat multi-hole tubes 50 that are connected to the second upper return portion 39 is larger than the number of the flat multi-hole tubes 50 that are connected to the first lower return portion 35. In addition, the number of the flat multi-hole tubes 50 that are connected to the first upper return portion 38 is larger than the number of the flat multi-hole tubes 50 that are connected to the second lower return portion 36.

An internal space of the first lower return portion 35 is partitioned in the up-down direction by a plurality of the baffles 80 that have no opening, thereby forming a plurality of flow-path-constituting spaces in line in the up-down direction.

In the lower return portion 34, the first lower return portion 35 and the second lower return portion 36 are also partitioned from each other in the up-down direction by the baffle 80 that has no opening.

Figure 9:
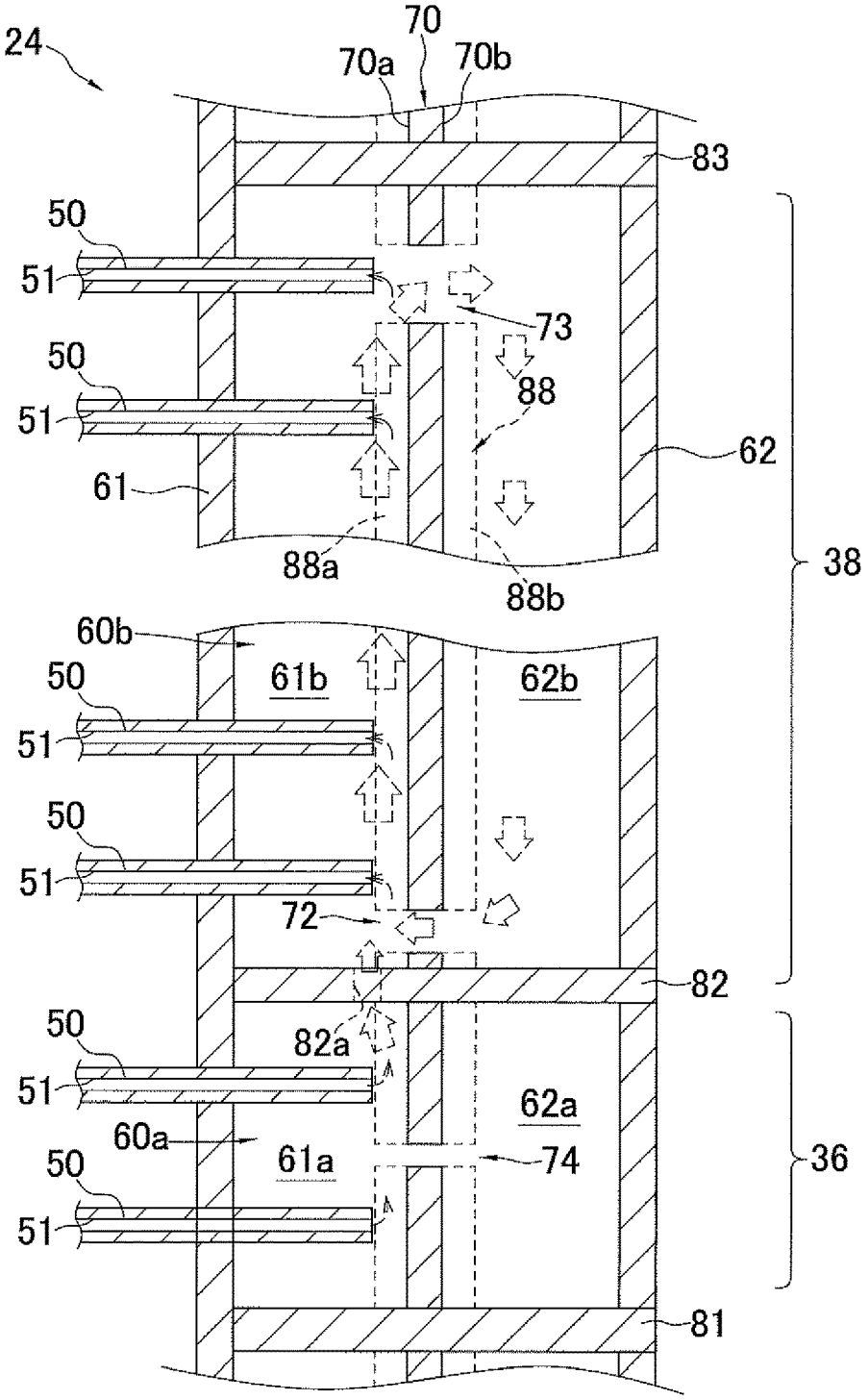
FIG. 9 is a schematic front view illustrating a loop structure at a second lower return portion and a first upper return portion of the return header.

FIG. 9 is a front view (the heat transfer fins 40 and the like are omitted) of the second lower return portion 36 and the first upper return portion 38 of the return header 24 cut along X-X cross section indicated in FIG. 8.

As illustrated in FIG. 9, the lower return portion 34 and the upper return portion 37 (the second lower return portion 36 and the first upper return portion 38) are partitioned from each other in the up-down direction by the rectifying plate 82, which is the baffle 80 in which ascending openings 82*a* that pass through in the plate-thickness direction are formed.

As illustrated in FIG. 9, an internal space of the second lower return portion 36 includes the first introducing space 61*a* and a second introducing space 62*a*. The first introducing space 61*a* and the second introducing space 62*a* are surrounded in the up-down direction by the rectifying plate 82 in which the ascending openings 82*a* are formed and a lower partition plate 81. The first introducing space 61*a* and the second introducing space 62*a* are partitioned from each other by the partitioning member 70 into the first introducing space 61*a* on the side of the flat multi-hole tubes 50 and the second introducing space 62*a* on a side opposite to the side of the flat multi-hole tubes 50. The first introducing space 61*a* and the second introducing space 62*a* communicate with each other via the pressure equalization opening 74 provided in the partitioning member 70. The connection pipes of the connection portion 25, which will be described later, are not connected to the second introducing space 62*a*, and the second introducing space 62*a* only communicates with the first introducing space 61*a* via the pressure equalization opening 74.

The first upper return portion 38 and the second upper return portion 39 of the upper return portion 37 are partitioned from each other in the up-down direction by an upper partition plate 83, which is the baffle 80 that has no opening.

Note that each of the lower partition plate 81 and the upper partition plate 83 is one of the baffles 80, and these partition plates are baffles 80 that have no opening and that have the same shape and the same dimensions; however, for convenience of description, the baffle 80 that constitutes a lower end of one set of spaces to be described is denoted by the lower partition plate 81 and the baffle 80 that constitutes an upper end thereof is denoted by the upper partition plate 83 in the description. The upper partition plate 83 of one set of spaces also functions as the lower partition plate 81 of another set of spaces above and adjacent to the one set of spaces.

As illustrated in FIG. 9, an internal space of the first upper return portion 38 includes the ascending space 61*b* and a descending space 62*b*. The ascending space 61*b* and the descending space 62*b* are surrounded in the up-down direction by the rectifying plate 82 in which the ascending openings 82*a* are formed and the upper partition plate 83. The ascending space 61*b* and the descending space 62*b* are partitioned from each other by the partitioning member 70 into the ascending space 61*b* on the side of the flat multi-hole tubes 50 and the descending space 62*b* on a side opposite to the side of the flat multi-hole tubes 50. The ascending space 61*b* and the descending space 62*b* communicate with each other in an upper portion via the upper communication passage 73 provided in the partitioning member 70. The ascending space 61*b* and the descending space 62*b* also communicate with each other in a lower portion via the lower communication passage 72 provided in the partitioning member 70.

Here, the number of the flat multi-hole tubes 50 that are connected to the first upper return portion 38 is larger than the number of the flat multi-hole tubes 50 that are connected to the second lower return portion 36 to distribute a refrigerant equally as much as possible in the first upper return portion 38.

In the one or more embodiments, the plurality of flat multi-hole tubes 50 connected to the return header 24 have the same shape and the same dimensions. The plurality of flat multi-hole tubes 50 are disposed in line in the up-down direction with a predetermined interval therebetween. For example, an interval between upper surfaces of mutually adjacent flat multi-hole tubes 50 in the up-down direction is equal. One end of each of the flat multi-hole tubes 50 is connected to the return header 24 so as to deeply enter inside the ascending space 61*b*. For example, the flat multi-hole tubes 50 are disposed so as to cover more than half the space of the ascending space 61*b* in the top view, but not limited thereto.

In the one or more embodiments, the number of the flat multi-hole tubes 50 that are connected to the ascending space 61*b* is twice or more and not more than five times the number of the flat multi-hole tubes 50 that are connected to the first introducing space 61*a*.

Figure 10:
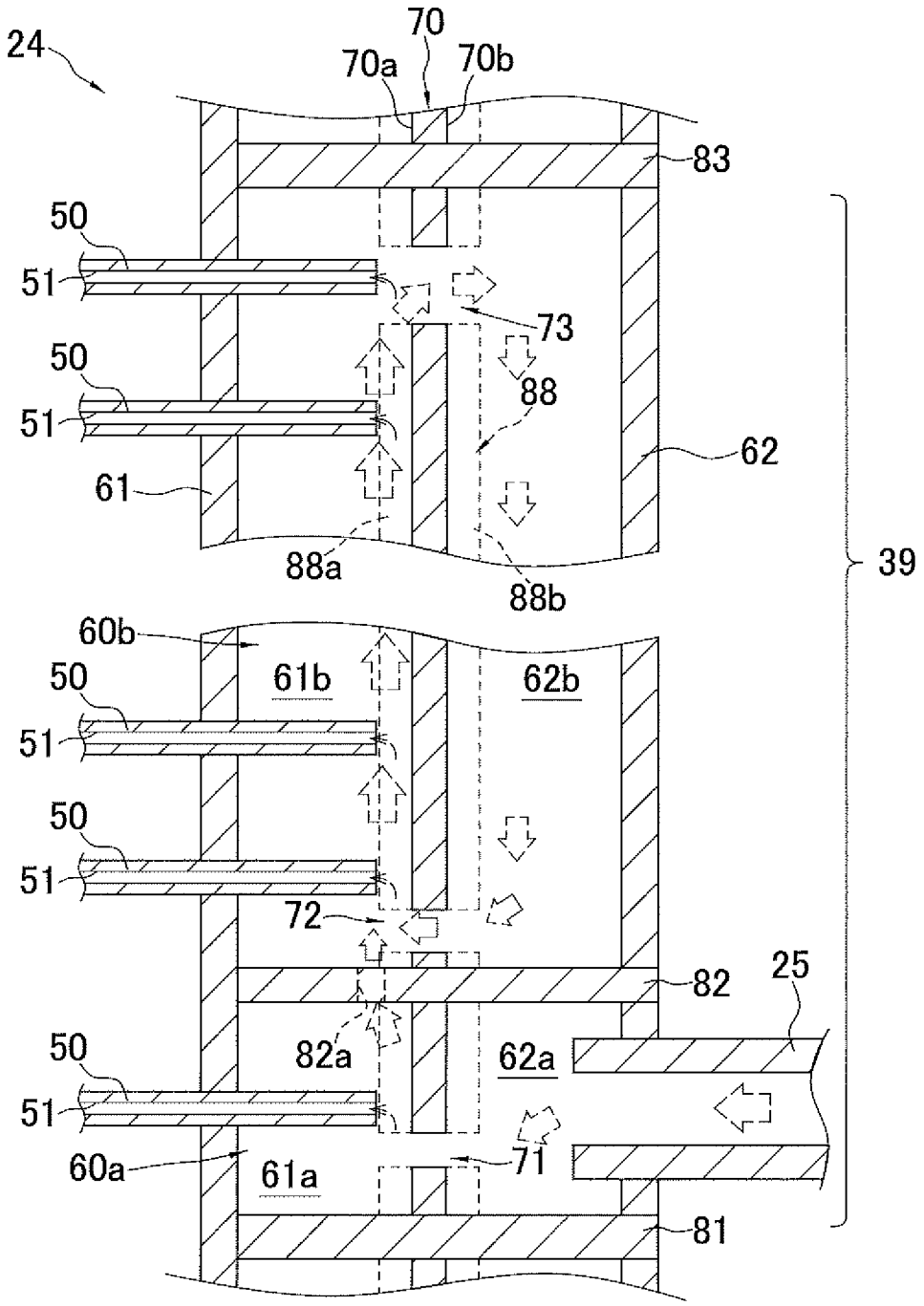
FIG. 10 is a schematic front view illustrating the loop structure at a second upper return portion of the return header.

FIG. 10 is a front view (the heat transfer fins 40 and the like are omitted) of the second upper return portion 39 cut along X-X cross section indicated in FIG. 8.

The second upper return portion 39 includes a plurality of flow-path-constituting spaces that are partitioned from each other so as to be adjacent in the up-down direction. Specifically, the flow-path-constituting spaces in line in the up-down direction in the second upper return portion 39 are partitioned from each other in the up-down direction by a plurality of the baffles 80 (the lower partition plate 81 and the upper partition plate 83) that each have no opening. Consequently, an up-down-direction distribution of a refrigerant that flows through the heat exchanging portion 21 is enabled to be maintained in the flow paths that are arranged in line in the up-down direction in the second upper return portion 39.

Internal spaces of the individual flow-path-constituting spaces of the second upper return portion 39 are different in that the first introducing space 61*a* and the second introducing space 62*a* communicate with each other via the introducing communication port 71 and different in the refrigerant inflow route; however, roughly similarly to the relationship between the second lower return portion 36 and the first upper return portion 38, as illustrated in FIG. 10, the internal space includes the first introducing space 61*a*, the second introducing space 62*a*, the ascending space 61*b*, and the descending space 62*b*. The first introducing space 61*a*, the second introducing space 62*a*, the ascending space 61*b*, and the descending space 62*b* are one set of spaces included in each of the flow-path-constituting spaces of the second upper return portion 39. Accordingly, a plurality of the sets of spaces are arranged in line in the up-down direction inside the second upper return portion 39. Here, the first introducing space 61*a* and the second introducing space 62*a* are surrounded in the up-down direction by the lower partition plate 81 and the rectifying plate 82 in which the ascending openings 82*a* are formed. The first introducing space 61*a* and the second introducing space 62*a* are partitioned from each other by the partitioning member 70 into the first introducing space 61*a* on the side of the flat multi-hole tubes 50 and the second introducing space 62*a* on a side opposite to the side of the flat multi-hole tubes 50. The first introducing space 61*a* and the second introducing space 62*a* communicate with each other via the introducing communication port 71 provided in the partitioning member 70. The connection pipes of the connection portion 25, which will be described later, are connected to the second introducing space 62*a*. The ascending space 61*b* and the descending space 62*b* are surrounded in the up-down direction by the upper partition plate 83 and the rectifying plate 82 in which the ascending openings 82*a* are formed. The ascending space 61*b* and the descending space 62*b* are partitioned from each other by the partitioning member 70 into the ascending space 61*b* on the side of the flat multi-hole tubes 50 and the descending space 62*b* on a side opposite to the side of the flat multi-hole tubes 50. The ascending space 61*b* and the descending space 62*b* communicate with each other in an upper portion via the upper communication passage 73 provided in the partitioning member 70. The ascending space 61*b* and the descending space 62*b* also communicate with each other in a lower portion via the lower communication passage 72 provided in the partitioning member 70. The opening area (refrigerant passage area) of the upper communication passage 73 is larger than the opening area (refrigerant passage area) of the lower communication passage 72.

Here, the number of the flat multi-hole tubes 50 that are connected to one set of the flow-path-constituting spaces of the second upper return portion 39 is larger than the number of the flat multi-hole tubes 50 that are connected to a corresponding one of the flow paths of the first lower return portion 35 connected via the connection pipes of the connection portion 25, which will be described later, to distribute a refrigerant equally as much as possible in one set of the flow paths of the second upper return portion 39.

(4-7) Connection Portion 25

The connection portion 25 includes a plurality of connection pipes. Each of the connection pipes connects, on a one-to-one basis, a respective one of a plurality of the flow-path-constituting spaces, which are divided from each other in the up-down direction in the first lower return portion 35 of the return header 24, and a respective one of a plurality of the sets of the spaces, which are arranged in line in the up-down direction in the second upper return portion 39 of the return header 24, to each other.

The connection pipes are disposed such that the lower the space is positioned in the first lower return portion 35, the higher the one set of the spaces that the space is connected to is positioned in the second upper return portion 39. The connection pipe of the connection portion 25 extending from one of the flow-path-constituting spaces of the first lower return portion 35 is connected to the second introducing space 62*a* of the second upper return portion 39.

Here, when the outdoor heat exchanger 20 functions as the refrigerant evaporator, each flow of the refrigerant that has flowed through the lower portion of the leeward-side heat exchanging portion 20*b* of the heat exchanging portion 21 first flows into the flow-path-constituting spaces of the lower return portion 34, as indicated by the arrows in FIG. 4 and FIG. 6, while maintaining the distributed state thereof. Each of the refrigerants that have flowed into respective flow-path-constituting spaces of the first lower return portion 35 is sent to one set of the spaces corresponding thereto in the second upper return portion 39 via respective connection pipes of the connection portion 25 provided on one-to-one basis. Each flow of the refrigerant that has been sent to respective one set of the spaces in the second upper return portion 39 flows toward the upper portion of the leeward-side heat exchanging portion 20*b* of the heat exchanging portion 21 again while maintaining the distributed state thereof. Here, the second lower return portion 36 positioned in the uppermost portion in the lower return portion 34 and the first upper return portion 38 positioned in the lowermost portion in the upper return portion 37 are not connected to each other by the connection pipes of the connection portion 25 and communicate with each other in the up-down direction via the ascending openings 82*a* of the rectifying plate 82 while being partitioned from each other in the up-down direction by the rectifying plate 82. As a result of the rectifying plate 82 having the ascending openings 82*a*, a refrigerant in the second lower return portion 36 does not flow outside from inside the return header 24 and is sent to the first upper return portion 38.

When the outdoor heat exchanger 20 functions as the refrigerant radiator, the flow of the refrigerant is roughly opposite to that described above.

Thus, the return header 24 constitutes an exact return portion in a refrigerant flowing route from an inlet to an outlet of the outdoor heat exchanger 20.

When the outdoor heat exchanger 20 functions as the refrigerant evaporator, a refrigerant that has flowed out from the return header 24 toward the upper portion of the leeward-side heat exchanging portion 20*b* flows through the upper portion of the leeward-side heat exchanging portion 20*b* to the coupling header 23 on the other end while maintaining the distributed state thereof, moves in the coupling header 23 toward the windward-side heat exchanging portion 20*a*, and flows through the upper portion of the windward-side heat exchanging portion 20*a* toward the upper portion of the entrance header tube 26 while maintaining the distributed state thereof, as indicated by the arrows in FIG. 4 and FIG. 6. Flows of the refrigerant that has flowed into the upper portion of the entrance header tube 26 are merged together and then flow toward the intake side of the compressor 91 via the gas refrigerant pipe 31.

(5) Loop Structure in Second Lower Return Portion 36 and First Upper Return Portion 38 of Return Header 24

Hereinafter, a loop structure will be described on the basis of FIG. 9 with a focus on spaces (one set of spaces) formed by one set of the first introducing space 61*a*, the second introducing space 62*a*, the ascending space 61*b*, and the descending space 62*b* in the second lower return portion 36 and the first upper return portion 38 of the return header 24.

The ascending openings 82*a* provided in the rectifying plate 82 causes the first introducing space 61*a* and the ascending space 61*b* to communicate with each other in the up-down direction. The ascending openings 82*a* each function in the rectifying plate 82 as a nozzle that narrows a flow path. In the one or more embodiments, two ascending openings 82*a* are separately provided on the upstream side and the downstream side in the airflow direction. The total area of the ascending openings 82*a* in the top view is, for example, not more than 20% of the first introducing space 61*a* in the top view. When a refrigerant that moves from the first introducing space 61*a* toward the ascending space 61*b* on the upper side passes through the ascending openings 82*a*, which function as nozzles, provided in the rectifying plate 82, the refrigerant passage area is sufficiently narrowed, and the flow speed of the refrigerant that moves in the vertical direction is thereby increased.

The ascending openings 82*a* provided in the rectifying plate 82 are arranged at positions that do not overlap the multi-hole-side concave-convex portion 88*a* in the top view. Consequently, the ascending openings 82*a* are suppressed from being closed by the multi-hole-side concave-convex portion 88*a*, and the refrigerant that passes through the ascending openings 82*a* to move upward is thus supplied to a sufficiently high position in the ascending space 61*b*.

As described above, the leeward side of the ascending space 61*b* is narrowed due to the provision of the multi-hole-side concave-convex portion 88*a*, and consequently, a large amount of the refrigerant passes through, of the two ascending openings 82*a* on the upstream side and the downstream side in the airflow direction, in particular, the ascending opening 82*a* on the upstream side in the airflow direction.

The ascending openings 82*a* of the rectifying plate 82 are provided at positions that do not overlap, in the top view, a space that is obtained by extending the lower communication passage 72 in the longitudinal direction of the flat multi-hole tubes 50. Therefore, the refrigerant that has flowed into the ascending space 61*b* through the ascending openings 82*a* of the rectifying plate 82 flows a portion excluding the flat multi-hole tubes 50 in the ascending space 61*b*, which is wider and easy to pass through, instead of back-flowing toward the descending space 62*b* through the lower communication passage 72, which is narrower and difficult to pass through.

In a space above the rectifying plate 82, the space inside the return header 24 is partitioned into the ascending space 61*b* and the descending space 62*b* by the partitioning member 70, and it is thus possible to decrease an area in which the refrigerant passes when ascending on the ascending space 61*b* so as to be narrower than a total horizontal area of the ascending space 61*b* and the descending space 62*b*. Therefore, it is easy to maintain the ascending speed of the refrigerant that has flowed into the ascending space 61*b* through the ascending openings 82*a*, and it is thus easy for the refrigerant to reach an upper portion of the ascending space 61*b* even under a circumstance in which the air conditioner 1 is operated at a low circulation rate.

The ascending openings 82*a* provided in the rectifying plate 82 and the flat multi-hole tubes 50 are arranged so as to have an overlapping portion in the top view. Therefore, the refrigerant that has passed through the ascending openings 82*a* of the rectifying plate 82 collides against portion of the flat multi-hole tubes 50, which enables the liquid refrigerant and the gas refrigerant to be stirred. Accordingly, it is possible to homogenize a gas-liquid mixture ratio of the refrigerant that is sent to the flat multi-hole tubes 50 disposed at respective height positions.

The refrigerant that has flowed, as described above, into the ascending space 61*b* through the ascending openings 82*a* of the rectifying plate 82 flows easily toward the windward side, where the pressure loss is small, because the space on the leeward side are narrowed by the multi-hole-side concave-convex portion 88*a* provided on the partitioning member 70. Consequently, in the flat multi-hole tubes 50 disposed at the respective height positions, a larger amount of the refrigerant is supplied to the windward side of the plurality of internal flow paths 51. Thus, in the ascending space 61*b*, a large amount of the refrigerant flows while ascending on the windward side and distributed by flowing into the flat multi-hole tubes 50 arranged at the respective height positions.

The refrigerant that has reached the upper portion of the ascending space 61*b* without flowing into the flat multi-hole tubes 50 is guided, as indicated by the arrows in FIG. 9, into the descending space 62*b* through the upper communication passage 73 and descends in the descending space 62*b* by gravity. The refrigerant that has descended in the descending space 62*b* is returned to the lower portion of the ascending space 61*b* through the lower communication passage 72.

Thus, it is possible to return the refrigerant that has passed through the ascending openings 82*a* of the rectifying plate 82 and has reached the upper portion of the ascending space 61*b* to the lower portion of the ascending space 61*b* again to cause the refrigerant to flow in a loop.

Here, due to the provision of the upper communication passage 73 in the upper portion of the ascending space 61*b*, it is possible to easily assure the flow of the refrigerant also in the upper region of the ascending space 61*b* compared with a case in which the upper portion of the ascending space 61*b* is a closed space without the provision of the upper communication passage 73.

Further, it is possible to return the refrigerant that has descended in the descending space 62*b* to a region of the ascending space 61*b* on the lower side again through the lower communication passage 72. Therefore, it is possible to guide the refrigerant that has passed through the lower communication passage 72 to these flat multi-hole tubes 50 even in a circumstance in which the ascending speed is excessively increased when the refrigerant passes through the ascending openings 82*a* of the rectifying plate 82 and in which the refrigerant thus does not easily flow into and easily passes by the flat multi-hole tubes 50 that are connected in the vicinity of the rectifying plate 82 in the lower portion of the ascending space 61*b*.

In one or more embodiments, the lower communication passage 72 is provided at a position below, of the flat multi-hole tubes 50 that are disposed above the rectifying plate 82 and that are connected to the ascending space 61*b*, the flat multi-hole tube 50 that is positioned in the lowermost portion. Accordingly, even in a circumstance in which the flow speed is high, it is possible to easily supply the refrigerant also to, of the flat multi-hole tubes 50 that are disposed above the rectifying plate 82 and that are connected to the ascending space 61*b*, the flat multi-hole tube 50 that is positioned in the lowermost portion.

(6) Loop Structure of Second Upper Return Portion 39 of Return Header 24

On the basis of FIG. 10, a loop structure will be described with a focus on one of a plurality of sets of spaces (a space including the first introducing space 61*a*, the second introducing space 62*a*, the ascending space 61*b*, and the descending space 62*b* as one set) arranged in the up-down direction in the second upper return portion 39 of the return header 24. The plurality of sets of the spaces arranged in the up-down direction in the second upper return portion 39 only differ from each other in terms of the connection pipes of the connection portion 25 to which the sets of the spaces are connected. The sets of the spaces are identical to each other in terms of internal structure.

Here, the one set of spaces in the second lower return portion 36 and the first upper return portion 38 illustrated in FIG. 9 and the one set of spaces in the second upper return portion 39 illustrated in FIG. 10 differ from each other in that no connection pipe of the connection portion 25 is connected in the one set of spaces in the second lower return portion 36 and the first upper return portion 38 while the connection pipes of the connection portion 25 are connected to the second introducing space 62*a* in the one set of spaces in the second upper return portion 39 and differ from each other in that the first introducing space 61*a* and the second introducing space 62*a* communicate with each other via the pressure equalization opening 74 in the one set of spaces in the second lower return portion 36 and the first upper return portion 38 while the first introducing space 61*a* and the second introducing space 62*a* communicate with each other via the introducing communication port 71 in the one set of spaces in the second upper return portion 39. However, these sets of spaces are substantially identical to each other in terms of other features, and the description thereof is thus omitted.

The connection pipe of the connection portion 25 that extends from one of the plurality of flow paths in line in the up-down direction in the first lower return portion 35 is connected to the second introducing space 62*a* of the second upper return portion 39. Here, an opening of an end portion of the connection pipe of the connection portion 25 in the second introducing space 62*a*, the internal flow paths 51 of the flat multi-hole tubes 50 that are connected to the first introducing space 61*a* adjacent to the second introducing space 62*a*, and the introducing communication port 71 provided in the partitioning member 70 are arranged so as not to be aligned with each other. Consequently, it is possible to suppress the refrigerant that has flowed into the second introducing space 62*a* through the connection pipe of the connection portion 25 from flowing concentratively into the flat multi-hole tubes 50 that are connected to the adjacent first introducing space 61*a*.

The refrigerant that has flowed into the first introducing space 61*a* through the connection pipe of the connection portion 25, the second introducing space 62*a*, and the introducing communication port 71 is narrowed at the ascending openings 82*a* of the rectifying plate 82, in the same manner as that in the aforementioned one set of spaces in the second lower return portion 36 and the first upper return portion 38, and ascends in the first introducing space 61*a*. A subsequent refrigerant flow in a loop is identical to that in the aforementioned one set of spaces in the second lower return portion 36 and the first upper return portion 38.

(7) Flowing Behavior of Refrigerant in Outdoor Heat Exchanger 20 at Low Circulation Rate During Heating Operation Flowing behavior of the refrigerant in the outdoor heat exchanger 20 as the evaporator when the circulation rate is low during heat operation will be described. Here, the loop structure of the second lower return portion 36 and the first upper return portion 38 and the loop structure of the second upper return portion 39 are described together.

In the outdoor heat exchanger 20, the refrigerant that flows from the first introducing space 61*a* into the ascending space 61*b* through the ascending openings 82*a* of the rectifying plate 82 is in a state in which a gas-phase component and a liquid-phase component, which are different in terms of specific gravity, are mixed.

Here, when the circulation rate is low, the amount of the refrigerant that flows into the ascending space 61*b* per unit time is small, and the flow speed of the refrigerant is relatively low. Therefore, the liquid-phase component, which has a large specific gravity, of the refrigerant is not easily caused to ascend. Thus, it tends to be difficult to cause the liquid-phase component having the large specific gravity to reach, of the plurality of flat multi-hole tubes 50 in the ascending space 61*b*, the flat multi-hole tubes 50 that are positioned in the upper portion. In this case, an amount of the refrigerant that passes through the plurality of flat multi-hole tubes 50 in the ascending space 61*b* becomes non-uniform in accordance with height positions, which generates unevenness in flow. When the gas-phase component, which has a small specific gravity, of the refrigerant mainly flows into one end side of the flat multi-hole tubes 50 that are arranged at a relatively high position, the degree of superheating of the refrigerant that flows out from the other end side of the flat multi-hole tubes 50 becomes excessively large, and the refrigerant stops generating a phase change in the middle of passing through the flat multi-hole tubes 50. As a result, a portion that is not capable of sufficiently exerting heat exchanging capacity is generated. In the meantime, when the liquid-phase component, which has a large specific gravity, of the refrigerant mainly flows into one end side of the flat multi-hole tubes 50 that are arranged at a relatively low portion, the degree of superheating of the refrigerant that flows out from the other end side of the flat multi-hole tubes 50 tends to be small, and the refrigerant may reach the other end side of the flat multi-hole tubes 50 without evaporating. As a result, a portion that is not capable of sufficiently exerting heat exchanging capacity is also generated.

Meanwhile, when the outdoor heat exchanger 20 according to one or more embodiments is used in a state in which the circulation rate is low, it is possible to guide the liquid-phase component, which has a large specific gravity, of the refrigerant that has been supplied to the ascending space 61*b* to a higher upper portion, and it is possible, even when the circulation rate is low, to reduce unevenness in flow among the flat multi-hole tubes 50 arranged in line in the up-down direction because a refrigerant-passage sectional area of the ascending space 61*b*, in which the refrigerant ascends, is reduced by the partitioning member 70.

Consequently, in the outdoor heat exchanger 20 according to one or more embodiments, it is possible, even when the circulation rate is low, to homogenize as much as possible the state of the refrigerant that flows into the plurality of flat multi-hole tubes 50 that are arranged at portions of the ascending space 61*b* at different height positions.

Moreover, even in the state in which the circulation rate is low, a space on the leeward side of the ascending space 61*b* is narrowed by the multi-hole-side concave-convex portion 88*a* provided on the partitioning member 70, and it is thus possible to cause a larger amount of the refrigerant to pass on the windward side than on the leeward side. Consequently, it is possible to guide the refrigerant concentratively to the windward side, where a heat exchange amount is large, in the plurality of internal flow paths 51 of each of the flat multi-hole tubes 50, and it is thus possible to improve the performance of the outdoor heat exchanger 20.

(8) Flowing Behavior of Refrigerant in Outdoor Heat Exchanger 20 at High Circulation Rate During Heating Operation Flowing behavior of the refrigerant in the outdoor heat exchanger 20 as the evaporator when the circulation rate is high during heat operation will be described. Here, the loop structure of the second lower return portion 36 and the first upper return portion 38 and the loop structure of the second upper return portion 39 are described together.

In the outdoor heat exchanger 20, the refrigerant that flows from the first introducing space 61*a* into the ascending space 61*b* is in a state in which a gas-phase component and a liquid-phase component, which are different in terms of specific gravity, are mixed, similarly to that when the circulation rate is low.

When the circulation rate is high, the amount of the refrigerant that flows into the ascending space 61*b* per unit time is large, and the flow speed of the refrigerant is relatively high. Moreover, as a result of employing a narrowing function of the ascending openings 82*a* as a countermeasure for the aforementioned low-circulation rate, the flow speed is further increased. In addition, the refrigerant-passage sectional area of the ascending space 61*b* is narrowed by the partitioning member 70 as a countermeasure for the aforementioned low-circulation rate, and the ascending speed of the refrigerant thus does not easily decrease. Consequently, when the circulation rate is high, the liquid-phase component, which has a large specific gravity, of the refrigerant that has vigorously passed through the ascending openings 82*a* tends to pass through the ascending space 61*b* without flowing into the flat multi-hole tubes 50 and gather in an upper portion. In this case, the liquid-phase component, which has a large specific gravity, gathers easily in an upper portion, and the gas-phase component, which has a small specific gravity, gathers easily in a lower portion. As a result, unevenness in flow, in which distribution however differs from that when the circulation rate is low, is also generated.

Meanwhile, in the outdoor heat exchanger 20 according to one or more embodiments, even when a large amount of the liquid-phase component of the refrigerant reaches an upper end of the ascending space 61*b*, it is possible to guide the refrigerant to the descending space 62*b* through the upper communication passage 73, cause the refrigerant to descend by gravity in the descending space 62*b*, and then return the refrigerant again to the lower portion of the ascending space 61*b* through the lower communication passage 72.

The refrigerant returned to a lower portion of the ascending space 61*b* through the lower communication passage 72 flows into the flat multi-hole tubes 50 connected at a position of the lower portion or ascends again inside the ascending space 61*b* by being drawn by the ascending flow of the refrigerant that has passed through the ascending openings 82*a* and is thereby enabled to flow into each of the flat multi-hole tubes 50 (the refrigerant may flow in a loop a plurality of times).

Consequently, in the outdoor heat exchanger 20 according to one or more embodiments, even when the circulation rate is high, it is possible to homogenize as much as possible the state of the refrigerant that flows into the plurality of flat multi-hole tubes 50, which are arranged at the portions of the ascending space 61*b* at the different height positions.

In addition, even when the circulation rate is high, it is possible to cause a larger amount of the refrigerant to pass on the windward side than on the leeward side because the space on the leeward side of the ascending space 61*b* is narrowed by the multi-hole-side concave-convex portion 88*a* provided on the partitioning member 70. Consequently, it is possible to guide the refrigerant concentratively to the windward side, where the heat exchange amount is large, of the plurality of the internal flow paths 51 in the flat multi-hole tubes 50, and it is thus possible to improve the performance of the outdoor heat exchanger 20.

(9) Features of Outdoor Heat Exchanger 20 of Air Conditioner 1

(9-1)

Generally, in a flat multi-hole tube that includes a plurality of internal flow paths arranged in line in the airflow direction, a temperature difference between air and a refrigerant is larger in the internal flow path on the upstream side than in the internal flow path on the downstream side, and thus, a heat exchange amount tends to be large on the upstream side. Therefore, the state of the refrigerant sometimes differs between the upstream side and the downstream side; for example, the degree of superheating of the refrigerant that has flowed through the internal flow path on the upstream side in the flat multi-hole tube tends to be large compared with that of the refrigerant that has flowed through the internal flow path on the downstream side. A difference in heat exchange amount between the windward side and the leeward side of the flat multi-hole tube is larger, in particular, when the shape of the heat transfer fins fixed to the flat multi-hole tube is not symmetrical in the airflow direction, that is, when the heat transfer fins are connected to each other only on the upstream side.

To solve this issue, each of the internal flow paths of the flat multi-hole tubes may be formed so as to have a passage sectional area that differs between the windward side and the leeward side. In this case, however, another issue of pressure-resistance strength, such as that a portion of the flat multi-hole tube in which the internal flow path is large is inferior to a portion thereof in which the internal flow path is small in terms of the pressure-resistance strength, is generated.

Meanwhile, in the outdoor heat exchanger 20 according to one or more embodiments, the provision of the multi-hole-side concave-convex portion 88*a* on the leeward side of the partitioning member 70 increases the space on the windward side in the first introducing space 61*a* and the ascending space 61*b*, and it is thus possible to cause a larger amount of the refrigerant to flow on the windward side than on the leeward side in the first introducing space 61*a* and the ascending space 61*b*. Therefore, it is possible to cause a larger amount of the refrigerant to flow through, of the plurality of internal flow paths 51 of the flat multi-hole tubes 50, the internal flow paths 51 on the upstream side than the internal flow paths 51 on the downstream side.

Accordingly, it is possible to suppress the degree of superheating of the refrigerant that has flowed through, of the internal flow paths 51 of the flat multi-hole tubes 50, the internal flow paths 51 on the windward side from easily increasing compared with the degree of superheating of the refrigerant that has flowed through the internal flow paths 51 on the leeward side, and it is thus possible to minimize the difference in state between the refrigerant that flows on the windward side and the refrigerant that flows on the leeward side of the internal flow paths 51 of the flat multi-hole tubes 50.

Moreover, in the flat multi-hole tubes 50, the plurality of internal flow paths 51 arranged in line in the airflow direction have a common size on the windward side and on the leeward side, and it is thus possible to suppress the internal flow paths 51 from being subjected to different refrigerant pressure. Accordingly, it is possible to minimize the difference in state between the refrigerant that flows on the windward side and the refrigerant that flows on the leeward side of the internal flow paths 51 of the flat multi-hole tubes 50 while maintaining the high pressure-resistance strength of the flat multi-hole tubes 50.

(9-2)

In the outdoor heat exchanger 20 according to one or more embodiments, the multi-hole-side concave-convex portion 88*a*, which is for narrowing the space on the leeward side of the first introducing space 61*a* and the ascending space 61*b*, is formed in the partitioning member 70 provided in the vicinity of the end portions of the flat multi-hole tubes 50 so as to face the end portions. Therefore, it is possible to sufficiently narrow the space between the multi-hole-side concave-convex portion 88*a* and the flat multi-hole tubes 50, and it is thus easy to cause the refrigerant to flow further toward the windward side.

(9-3)

In the outdoor heat exchanger 20 according to one or more embodiments, the flat multi-hole tubes 50 each have the shape that is symmetrical between the upstream side and the downstream side with respect to the center in the airflow direction.

Therefore, it is possible to obtain the same shape during the manufacture of the outdoor heat exchanger 20 regardless of whether construction is performed with the flat multi-hole tubes 50 directed toward the upstream side or toward the downstream side during assembling of the flat multi-hole tubes 50. Accordingly, it is possible to suppress occurrence of incorrect assembling during manufacture relating to the flat multi-hole tubes 50.

(9-4)

When the outdoor heat exchanger 20 according to one or more embodiments functions as the refrigerant evaporator, the entire ascending space 61*b* is narrowed due to the provision of the partitioning member 70 inside the return header 24, and it is thus possible to reduce the passage sectional area when the refrigerant flows by ascending. Therefore, it is easy, even when the circulation rate of the refrigerant is low, to cause the refrigerant to reach the upper portion of the ascending space 61*b* by minimizing a decrease in the ascending speed of the refrigerant.

In addition, when the outdoor heat exchanger 20 functions as the refrigerant evaporator, the refrigerant is suppressed from easily gathering in the upper portion of the ascending space 61*b* due to the provision of the upper communication passage 73. Therefore, it is possible, even when the circulation rate of the refrigerant is high, to easily guide the refrigerant again to the side of the ascending space 61*b* through the descending space 62*b* and the lower communication passage 72.

(10) Other Embodiments

The aforementioned embodiments are described as examples of one or more embodiments of the present invention. However, the aforementioned embodiments do not intend to limit the invention of the present application, and the invention of the present application is not limited to the aforementioned embodiments. The invention of the present application includes, as a matter of course, appropriate modifications within a range not deviating from the spirit thereof.

(10-1) Other Embodiment A

The aforementioned embodiments have been described by presenting examples in which the multi-hole-side concave-convex portion 88*a* is provided on the leeward side of the partitioning member 70 to cause a larger amount of the refrigerant to flow on the windward side in the first introducing space 61*a* and the ascending space 61*b* inside the return header 24.

Figure 11:
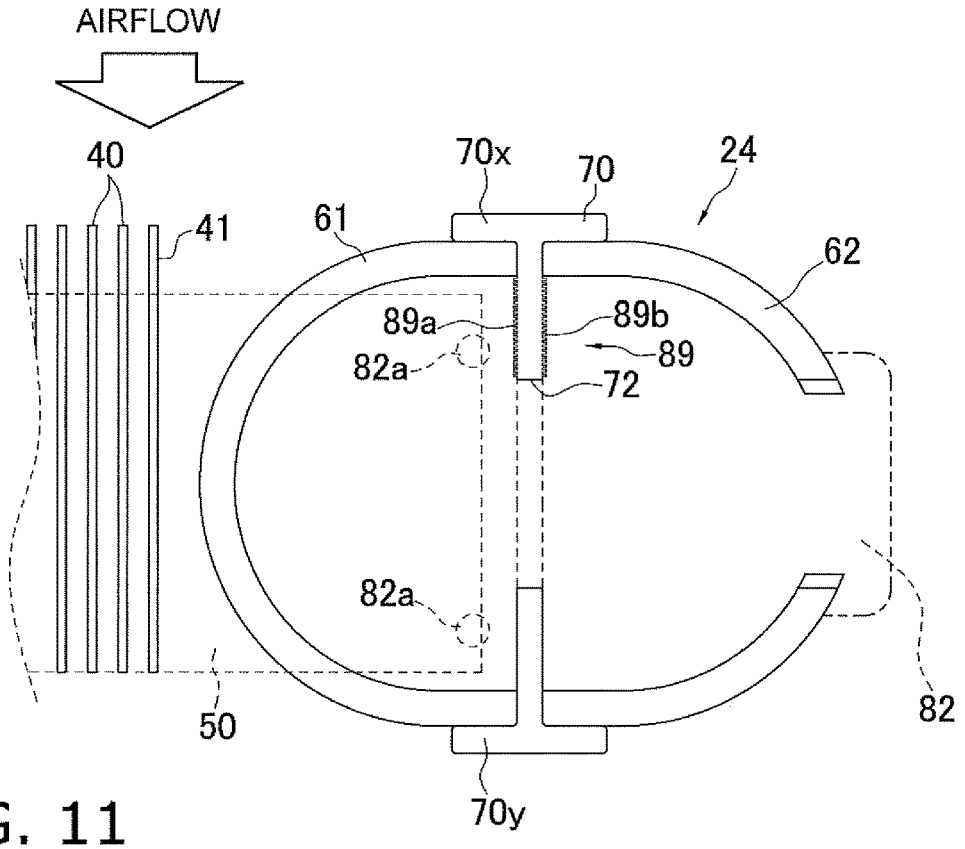
FIG. 11 is a top view of an assembly of the rectifying plate, the multi-hole-side member, the pipe-side member, and the partitioning member according to another example of one or more embodiments (A).

However, the structure that increases the specific surface area at the portion facing the end portions of the flat multi-hole tubes 50 more on the windward side than on the leeward side is not limited thereto. For example, as illustrated in FIG. 11, instead of providing the concave-convex shaped portion 88 of the aforementioned embodiments, a specific-surface-area increasing portion 89 may be provided on the windward side of the partitioning member 70 to increase the specific surface area at the portion of the partitioning member 70 facing the end portions of the flat multi-hole tubes 50 more on the windward side than on the leeward side.

Employing the specific-surface-area increasing portion 89 on the windward side of the partitioning member 70, as described above, causes a large amount of the liquid refrigerant to be easily held on the windward side of the partitioning member 70, and it is thus possible to cause a larger amount of the refrigerant including the liquid refrigerant to flow on the windward side of the internal flow paths 51 of the flat multi-hole tubes 50. In particular, it is possible to hold the liquid refrigerant at the position of the partitioning member 70, which is arranged in the vicinity of the end portions of the flat multi-hole tubes 50 so as to face the end portions, and therefore, the position at which the liquid refrigerant is held and inlets of the internal flow paths 51 of the flat multi-hole tubes 50 are enabled to be positioned relatively close to each other. It is consequently possible to efficiently guide the held liquid refrigerant to the internal flow paths 51 of the flat multi-hole tubes 50.

The specific-surface-area increasing portion 89 is not limited provided that the shape thereof is effective for holding the liquid refrigerant by using capillarity. For example, the specific-surface-area increasing portion 89 may be realized by forming the surface of the partitioning member 70 on the windward side into a fine concave-convex shape or may be realized by arranging a sponge-like net-shaped member that easily holds the refrigerant on the leeward side of the partitioning member 70. Specifically, the specific-surface-area increasing portion 89 may be formed such that the specific surface area of the portion that faces the end portions of the flat multi-hole tubes 50 is larger on the upstream side than on the downstream side in the airflow direction, the specific surface area being a surface area of a projection plane per unit area in the insertion direction (the longitudinal direction of the flat multi-hole tubes 50 at a portion where the flat multi-hole tubes 50 and the return header 24 are connected to each other) of the end portions of the flat multi-hole tubes 50. When forming the surface of the partitioning member 70 on the windward side into a fine concave-convex shape, the concave-convex shape may be formed so as to extend continuously in the up-down direction.

The specific-surface-area increasing portion 89 may include only a multi-hole-side specific-surface-area increasing portion 89*a* on the side where the flat multi-hole tubes 50 are connected with respect to the partitioning member 70 or may additionally include a pipe-side specific-surface-area increasing portion 89*b* on a side opposite to the side where the flat multi-hole tubes 50 are connected with respect to the partitioning member 70. When the specific-surface-area increasing portion 89 includes not only the multi-hole-side specific-surface-area increasing portion 89*a* but also the pipe-side specific-surface-area increasing portion 89*b*, it is possible, even when the liquid refrigerant reaches the upper communication passage 73 while being held at the multi-hole-side specific-surface-area increasing portion 89*a*, to guide the liquid refrigerant again to the multi-hole-side specific-surface-area increasing portion 89*a* through the lower communication passage 72 by causing the liquid refrigerant to descend in the descending space 62*b* while being held at the pipe-side specific-surface-area increasing portion 89*b*. Therefore, it is possible to more efficiently supply a large amount of the refrigerant including the liquid refrigerant to the internal flow paths 51 of the flat multi-hole tubes 50 on the windward side.

As a result of the multi-hole-side specific-surface-area increasing portion 89*a*, at which the liquid refrigerant is easily held, being provided at the position facing the internal flow paths 51 of the flat multi-hole tubes 50 so as to extend in the up-down direction, the refrigerant is easily supplied to the upper portion of the ascending space 61*b* even when the circulation rate of the refrigerant is low.

(10-2) Other Embodiment B

Figure 12:
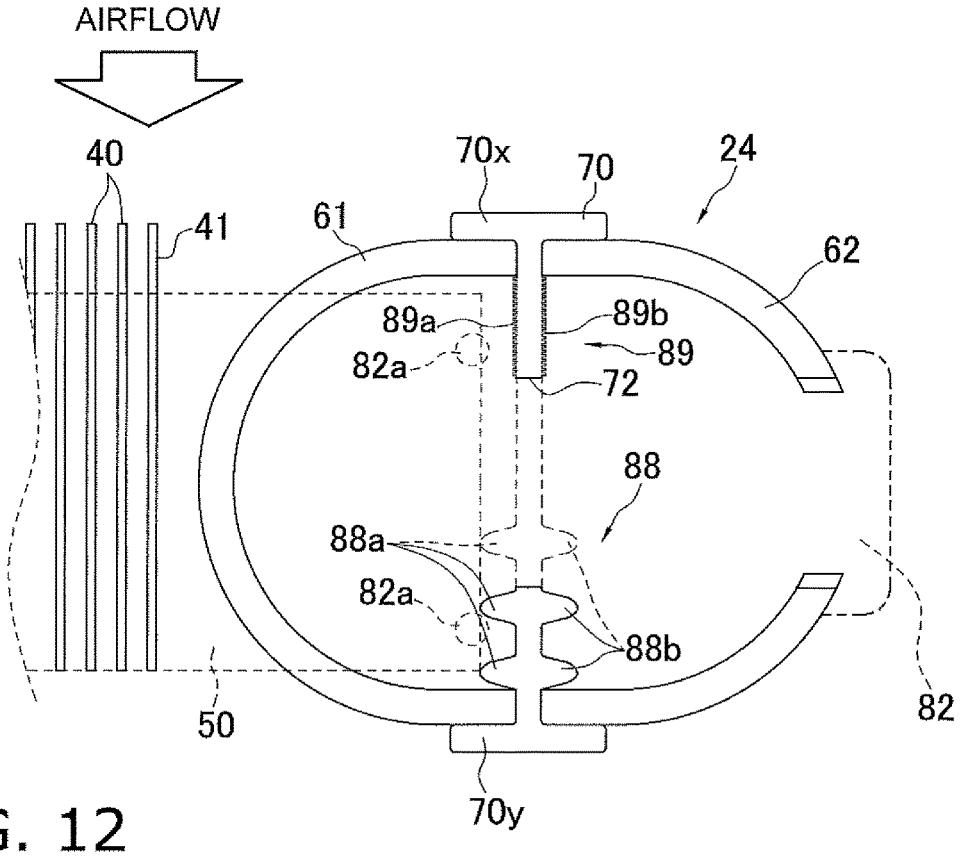
FIG. 12 is a top view of an assembly of the rectifying plate, the multi-hole-side member, the pipe-side member, and the partitioning member according to another example of one or more embodiments (B).

In addition, for example, as illustrated in FIG. 12, both the concave-convex shaped portion 88 of the aforementioned embodiments and the specific-surface-area increasing portion 89 of the aforementioned other embodiment A may be employed.

In particular, the multi-hole-side specific-surface-area increasing portion 89*a* may be provided on the windward side of the partitioning member 70 while providing the multi-hole-side concave-convex portion 88*a* on the leeward side of the partitioning member 70.

Here, when providing the multi-hole-side specific-surface-area increasing portion 89*a*, which has the fine concave-convex shape, on the windward side while providing the multi-hole-side concave-convex portion 88*a* on the leeward side, an interval in the airflow direction between apex portions of convex portions of the multi-hole-side concave-convex portion 88*a* may be wider (twice or more) than a gap between convex portions of fine concave-convex shape of the multi-hole-side specific-surface-area increasing portion 89*a*. Consequently, it is possible to reduce the passing resistance of the refrigerant on the windward side so as to be sufficiently smaller than that on the leeward side by causing a sufficient amount of the liquid refrigerant to be held at the multi-hole-side specific-surface-area increasing portion 89*a* on the windward side while suppressing the liquid refrigerant from being held at the multi-hole-side concave-convex portion 88*a* on the leeward side, thereby increasing the amount of the refrigerant that passes on the windward side so as to be remarkably larger than that on the leeward side.

From the point of view of sufficiently narrowing the refrigerant paths on the leeward side, the height of the convex portions of the multi-hole-side concave-convex portion 88*a* is higher than the height of the convex portions of the multi-hole-side specific-surface-area increasing portion 89*a*, which has the fine concave-convex shape.

(10-3) Other Embodiment C

The aforementioned embodiments have been described by presenting examples in which the ascending openings 82*a* provided in the rectifying plate 82 and the flat multi-hole tubes 50 are arranged so as to have the overlapping portion in the top view.

Figure 13:
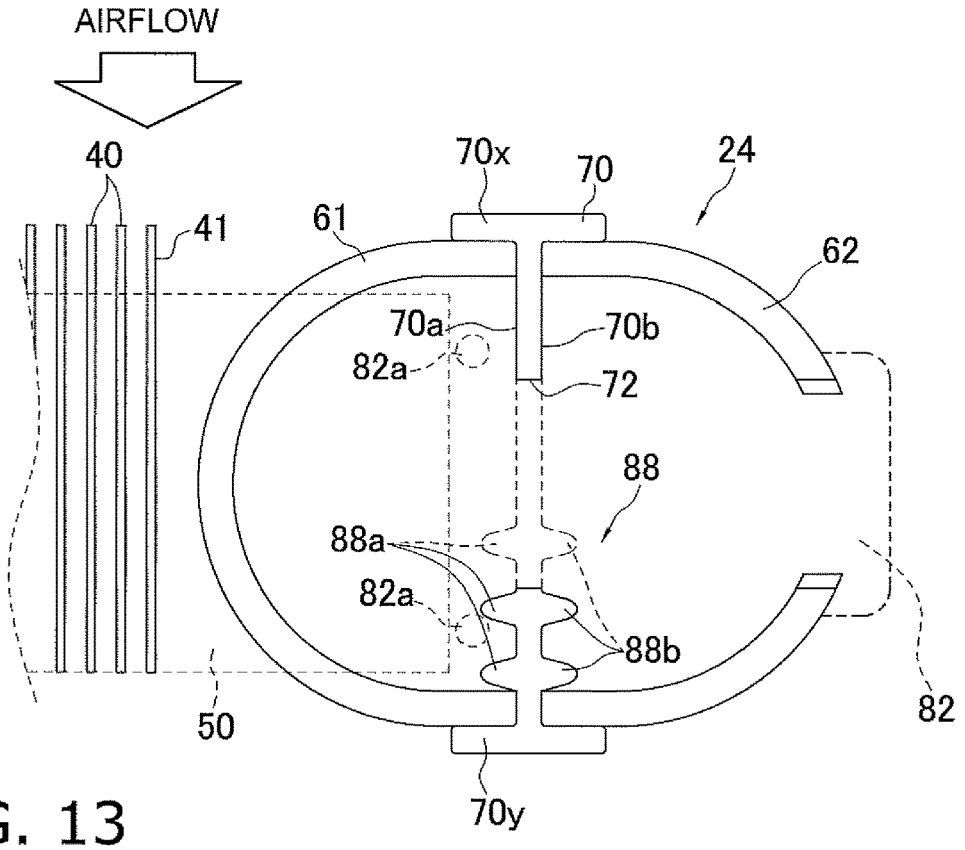
FIG. 13 is a top view of an assembly of the rectifying plate, the multi-hole-side member, the pipe-side member, and the partitioning member according to another example of one or more embodiments (C).

Meanwhile, for example, the ascending openings 82*a* provided in the rectifying plate 82 and the flat multi-hole tubes 50 may be arranged so as not to overlap each other, as illustrated in the top view in FIG. 13, to cause the refrigerant that has passed through the ascending openings 82*a* of the rectifying plate 82 to be easily supplied to the upper portion of the ascending space 61*b*.

(10-4) Other Embodiment D

The aforementioned embodiments have been described by presenting examples in which the ascending openings 82*a* provided in the rectifying plate 82 and the multi-hole-side concave-convex portion 88*a* are arranged so as not to overlap each other in the top view.

Figure 14:
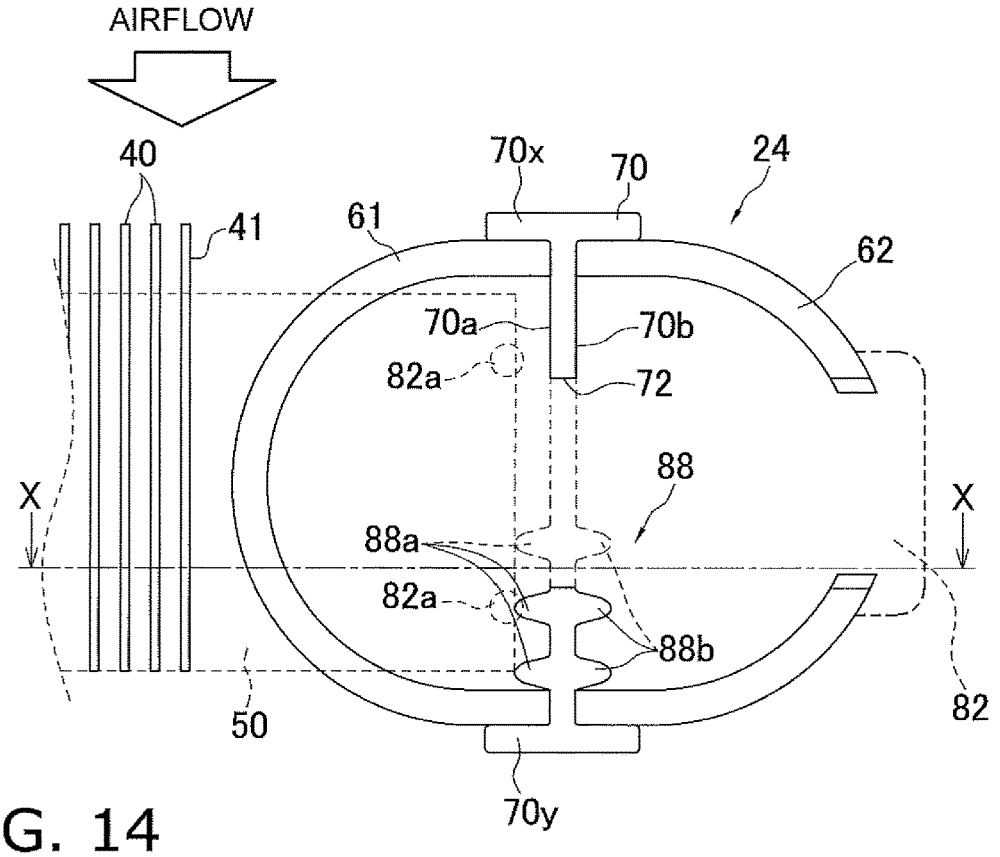
FIG. 14 is a top view of an assembly of the rectifying plate, the multi-hole-side member, the pipe-side member, and the partitioning member according to another example of one or more embodiments (D).

Meanwhile, for example, the ascending openings 82*a* of the rectifying plate 82 and the multi-hole-side concave-convex portion 88*a* may be arranged so as to have an overlapping portion in the top view, as illustrated in the top view in FIG. 14, to cause the refrigerant that has passed through the ascending openings 82*a* of the rectifying plate 82 to collide with the multi-hole-side concave-convex portion 88*a* and to be easily guided to the windward side.

Figure 15:
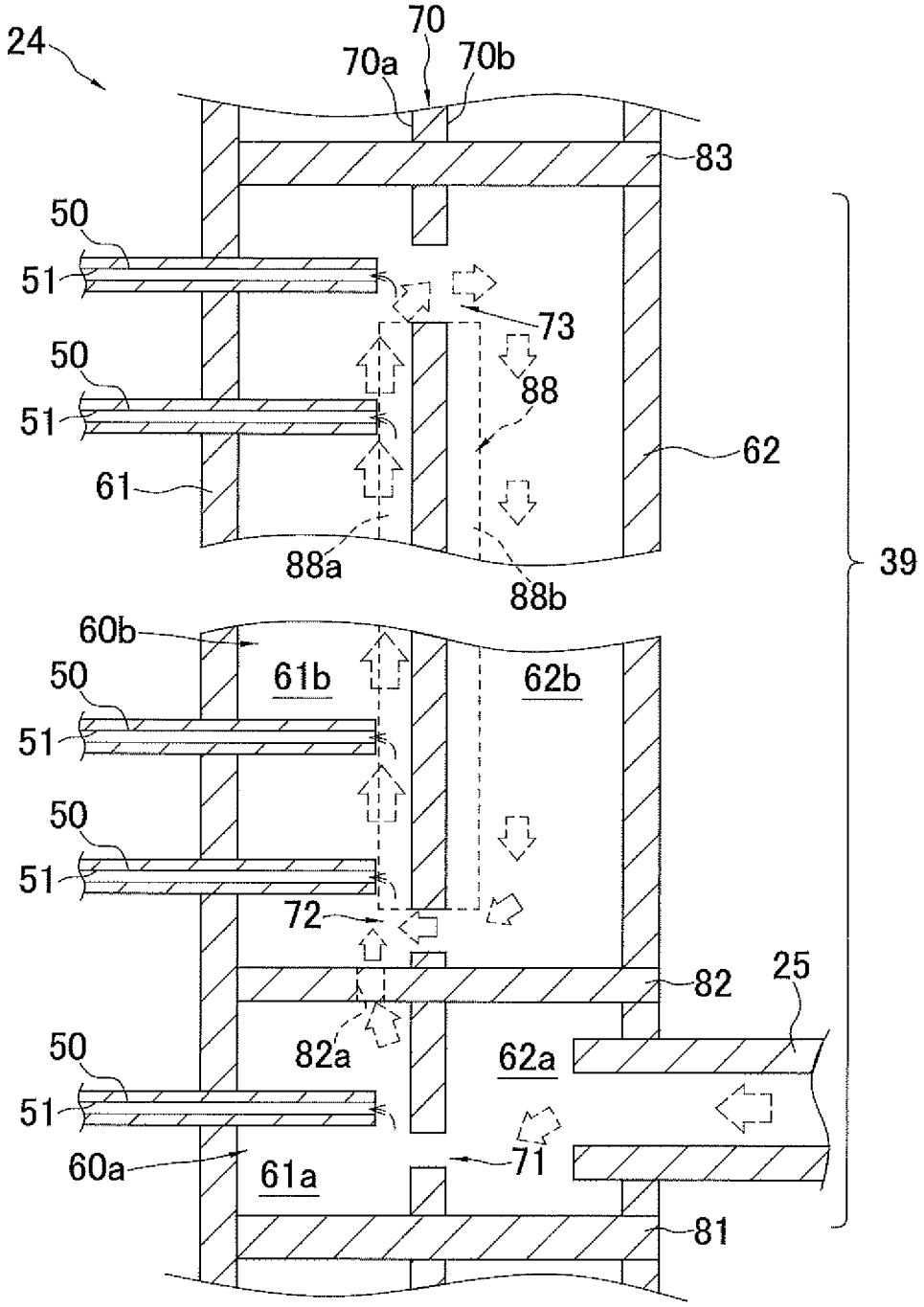
FIG. 15 is a schematic front view illustrating a loop structure of the second upper return portion of the return header according to another example of one or more embodiments (D).

In this case, as illustrated in FIG. 15, which is a view in which X-X cross section in FIG. 14 is viewed from the front side, the multi-hole-side concave-convex portion 88*a* may be provided on the partitioning member 70 only between the upper communication passage 73 and the lower communication passage 72. Consequently, it is possible to cause the refrigerant that has passed through the ascending opening 82*a* of the rectifying plate 82 on the downstream side in the airflow direction to collide with a lower end of the multi-hole-side concave-convex portion 88*a* while suppressing the ascending opening 82*a* of the rectifying plate 82 on the downstream side in the airflow direction from being closed by the multi-hole-side concave-convex portion 88*a*.

(10-5) Other Embodiment E

The aforementioned embodiments have been described by presenting examples in which the inside of the return header 24 is partitioned by the partitioning member 70 into a space on the side of the flat multi-hole tubes 50 and a space on the side opposite to the side of the flat multi-hole tubes 50 and in which a space on the leeward side in the space on the side of the flat multi-hole tubes 50 is narrowed by providing the multi-hole-side concave-convex portion 88*a*.

Figure 16:
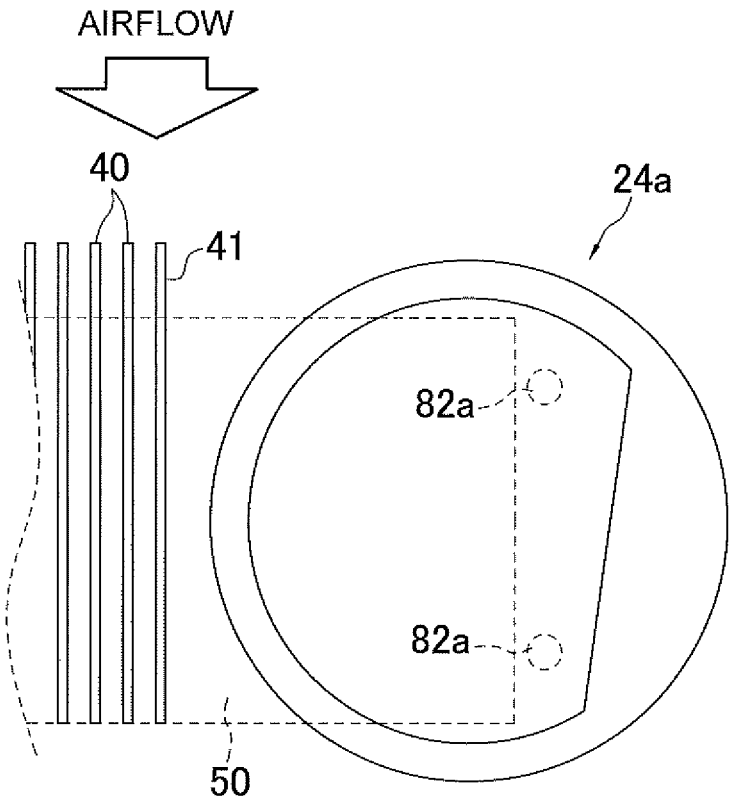
FIG. 16 is a top view illustrating an example of the structure inside the return header according to another example of one or more embodiments (E).

Meanwhile, for example, the inside of a header 24*a* to which the flat multi-hole tubes 50 are connected may not be partitioned, as illustrated in the top view in FIG. 16, by the partitioning member 70 as is in the aforementioned embodiments, and instead of the multi-hole-side concave-convex portion 88*a* in the aforementioned embodiments, a space inside the header 24*a* on the leeward side may be narrowed by the shape of an inner wall surface of the header 24*a*.

In other words, it becomes possible to cause the refrigerant that flows inside the header 24*a* to gather on the windward side, where the pressure loss is small, by employing a shape that is closer to the end portions of the flat multi-hole tubes 50 toward the leeward side as the shape of a portion of the inner wall of the header 24*a* facing the end portions of the flat multi-hole tubes 50.

(10-6) Other Embodiment F

The aforementioned embodiments have been described by presenting, as examples, the outdoor heat exchanger 20 that has a configuration in which, as illustrated in FIG. 4 and other drawings, a plurality of the heat exchanging portions 20*a*, 20*b* are disposed in line in the airflow direction, in which a refrigerant is caused to flow so as to return in the heat exchanging portions 20*a*, 20*b* that are arranged in line at a lower portion, and in which the refrigerant is caused to flow so as to also return in the heat exchanging portions 20*a*, 20*b* that are arranged in line at an upper portion.

Meanwhile, the configuration of the flow paths of the refrigerant in the heat exchanger is however not limited thereto. For example, a heat exchanger that has a configuration in which a refrigerant flows only from one header toward the other header without being caused to flow so as to return may be used.

In addition, as is in the aforementioned embodiments, when the flat multi-hole tubes are provided separately in two rows on the upstream side and the downstream side in the airflow direction with the heat exchanging portions 20*a*, 20*b* not being divided into the heat exchanging portions 20*a*, 20*b* on the upper side and the heat exchanging portions 20*a*, 20*b* on the lower side, the heat exchanger may have a configuration in which a refrigerant that has flowed in from one end side of the heat exchanger in the top view is caused to flow through the flat multi-hole tubes in one of the rows and caused to flow again through the flat multi-hole tubes in the other row after returning at the other end side of the heat exchanger in the top view so as to be returned to the one end side of the heat exchanger in the top view and flow out from the heat exchanger.

Although the disclosure has been described with respect to a limited number of embodiments, those skilled in the art, having benefit of this disclosure, will appreciate that various other embodiments may be devised without departing from the scope of the present invention. Accordingly, the scope of the present invention should be limited only by the attached claims.

REFERENCE SIGNS LIST

1 air conditioner
2 air-conditioning outdoor unit
3 air-conditioning indoor unit
8 refrigerant circuit
20 outdoor heat exchanger (heat exchanger)
21 heat exchanging portion
22 distributor
23 coupling header
24 return header (header)
24*a* header
25 connection portion
26 entrance header tube
31 gas refrigerant pipe
32 liquid refrigerant pipe
40 heat transfer fin (fin)
41 windward communication portion
42 slit
43 opening
50 flat multi-hole tube
51 internal flow path (flow path)
61 multi-hole-side member
61*a* first introducing space
61*b* ascending space (first space)
62 pipe-side member
62*a* second introducing space
62*b* descending space (second space)
70 partitioning member
70*a* multi-hole-side surface
70*b* pipe-side surface
71 introducing communication port
72 lower communication passage (second communication passage)
73 upper communication passage (first communication passage)
80 baffle
81 lower partition plate
82 rectifying plate
82*a* ascending openings (inflow port)
83 upper partition plate

88 concave-convex shaped portion
88*a* multi-hole-side concave-convex portion (concave-convex portion)
88*b* pipe-side concave-convex portion
89 specific-surface-area increasing portion
89*a* specific-surface-area increasing portion (specific-surface-area difference structure)
89*b* specific-surface-area increasing portion
91 compressor
95 outdoor fan (fan)

CITATION LIST

Patent Literature

Patent Literature 1: Japanese Unexamined Patent Application Publication No. 2005-201491

Patent Literature 2: Japanese Unexamined Patent Application Publication No. 2005-127597

The invention claimed is:

1. A heat exchanger comprising:

flat multi-hole tubes that are disposed in line such that a direction intersecting an airflow direction is a longitudinal direction of each of the flat multi-hole tubes;

a header to which an end portion of each of the flat multi-hole tubes is connected;

fins that are joined to the flat multi-hole tubes; and a partition disposed inside the header, wherein the partition partitions a first side where the flat multi-hole tubes are connected and a second side opposite to the first side, the partition comprises a concave-convex portion at the first side only on a downstream side in the airflow direction with respect to a center of the partition, the concave-convex portion includes convex portions that project toward the flat multi-hole tubes and concave portions that are oppositely recessed, the convex portions and the concave portions extend in a longitudinal direction of the header respectively.

2. The heat exchanger according to claim 1, wherein a space inside the header is wider on the upstream side than on the downstream side in the airflow direction such that the refrigerant passes through the space on the upstream side.

3. The heat exchanger according to claim 1, wherein the partition comprises an upstream side surface portion and a downstream side surface portion, the downstream side surface portion is disposed on the downstream side in the airflow direction relative to the upstream side surface portion, the upstream side surface portion faces the end portion of each of the flat multi-hole tubes, and the upstream side surface portion has a larger surface area than the downstream side surface portion.

4. The heat exchanger according to claim 1, wherein each of the flat multi-hole tubes has a shape that is symmetrical on the upstream side and the downstream side around an intermediate position in the airflow direction, and each of the flat multi-hole tubes includes flow paths that have a common flow-path sectional area.

5. The heat exchanger according to claim 1, wherein the fins are connected to each other on the upstream side of the flat multi-hole tubes in the airflow direction.

6. The heat exchanger according to claim 1, wherein the header has a loop structure including:

an inflow port through which the refrigerant is caused to flow into a first space on the first side when the heat exchanger functions as a refrigerant evaporator;

a first communication passage via which a portion of the first space toward a first end in the longitudinal direction of the header and a portion of a second space toward the first end in the longitudinal direction of the header communicate with each other, and through which the refrigerant that has flowed inside the first space is guided to the second space on a side opposite to the first side; and a second communication passage through which the refrigerant that has flowed in the second space is returned to a second end of the first space opposite to the first end in the longitudinal direction of the header.

7. The heat exchanger according to claim 1, wherein the flat multi-hole tubes are disposed in line in a vertical direction.

8. An air conditioner comprising:

a refrigerant circuit that includes the heat exchanger according to claim 1 and that causes the refrigerant to circulate therein; and a fan that supplies airflow to the heat exchanger.

9. The heat exchanger according to claim 1, wherein a body of the header comprises a multi-hole-side member and a pipe-side member that are distinct from one another, and the partition separates the multi-hole-side member from the pipe-side member.

* * * * *